US007601907B2

(12) United States Patent
Kobayashi

(10) Patent No.: US 7,601,907 B2
(45) Date of Patent: Oct. 13, 2009

(54) SIGNAL PROCESSING APPARATUS AND METHOD, PROGRAM, AND RECORDING MEDIUM

(75) Inventor: Yoshiyuki Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 59 days.

(21) Appl. No.: 11/873,080

(22) Filed: Oct. 16, 2007

(65) Prior Publication Data

US 2008/0245215 A1 Oct. 9, 2008

(51) Int. Cl.
*G10H 1/38* (2006.01)

(52) U.S. Cl. ..... 84/613; 84/609; 84/637; 84/649; 84/669

(58) Field of Classification Search ..... None
See application file for complete search history.

(56) References Cited

U.S. PATENT DOCUMENTS

| | | | | |
|---|---|---|---|---|
| 2005/0211077 | A1 | 9/2005 | Kobayashi | |
| 2008/0034947 | A1* | 2/2008 | Sumita | 84/613 |
| 2008/0034948 | A1* | 2/2008 | Sumita | 84/636 |
| 2008/0092722 | A1* | 4/2008 | Kobayashi | 84/661 |

FOREIGN PATENT DOCUMENTS

| | | |
|---|---|---|
| JP | 6-34170 | 5/1994 |
| JP | 2002-78100 | 3/2002 |
| JP | 2002-244677 | 8/2002 |
| JP | 2005-275068 | 10/2005 |
| JP | 3826660 | 7/2006 |
| JP | 2006-202235 | 8/2006 |
| JP | 2007-052394 | 3/2007 |

OTHER PUBLICATIONS

Masato Sugano et al., "Chord Recognition Using Gaussian Mixture Model", the Institute of Electronics, Information, and Communication Engineers, vol. 103, No. 147, Jun. 27, 2003, pp. 31-36.

Notification of Reasons for Refusal dated by the Japanese Patent Office on Oct. 3, 2008 in counterpart Japanese Patent Application No. 2006-286260.

* cited by examiner

*Primary Examiner*—Marlon T Fletcher
(74) *Attorney, Agent, or Firm*—Finnegan, Henderson, Farabow, Garrett & Dunner, L.L.P.

(57) ABSTRACT

Disclosed herein is a signal processing apparatus, including: removal means for removing, from a sound signal in the form of a stereo signal, a center component which is a component of sound positioned at the center between the left and the right; extraction means for extracting, from the sound signal from which the center component is removed, first feature quantity representative of characteristics of sounds of different tones of the 12-tone equal temperament within a predetermined range; and decision means for deciding a chord within the predetermined range using the first feature quantity.

12 Claims, 38 Drawing Sheets

SIGNAL PROCESSING APPARATUS AND METHOD, PROGRAM, AND RECORDING MEDIUM

CROSS REFERENCES TO RELATED APPLICATIONS

The present invention contains subject matter related to Japanese Patent Application JP 2006-286260 filed with the Japan Patent Office on Oct. 20, 2006, the entire contents of which being incorporated herein by reference.

BACKGROUND OF THE INVENTION

1. Field of the Invention

This invention relates to a signal processing apparatus and method, a program, and a recording medium, and more particularly to a signal processing apparatus and method, a program, and a recording medium by which a sound signal is processed.

2. Description of the Related Art

Various signal processing apparatus are utilized widely which apply various signal processes to a sound signal which is a signal of sound.

One of such signal processing apparatus as mentioned above includes a re-sampling section which re-samples san audio signal inputted thereto with a sampling frequency of the power of two of a frequency on the boundary of an octave. An octave division block divides the audio signal outputted from the re-sampling section into eight octaves and outputs resulting signals to respective BPFBs. Each of the BPFBs has twelve BPFs such that it extracts and outputs twelve audio signals of different tones from the audio signal of one octave inputted thereto. (for example, referred to as Japanese Patent Laid-Open No. 2005-275068)

SUMMARY OF THE INVENTION

However, where it is tried to decide a chord of a piece of music, that is, an accord, from a sound signal of the piece of music, the signal processing apparatus sometimes fails in decision of a correct chord.

Therefore, it is demanded to provide a signal processing apparatus and method, a program, and a recording medium wherein a root of a chord of a sound signal of a piece of music can be decided accurately from the sound signal.

According to an embodiment of the present invention, there is provided a signal processing apparatus including removal means for removing, from a sound signal in the form of a stereo signal, a center component which is a component of sound positioned at the center between the left and the right, extraction means for extracting, from the sound signal from which the center component is removed, first feature quantity representative of characteristics of sounds of different tones of the 12-tone equal temperament within a predetermined range, and decision means for deciding a chord within the predetermined range using the first feature quantity.

The signal processing apparatus may further include detection means for detecting the position of each of beats from the sound signal, the extraction means extracting the first feature quantity within a range of each of the beats of the sound signal which is the predetermined range, the decision means deciding a chord within the range of the beat using the first feature quantity.

The removal means may determine the difference between signals of one and the other of the channels of the sound signal which is in the form of a stereo signal to remove the center component from the sound signal.

The removal means may divide the sound signal in the form of a stereo signal into signals of a predetermined number of frequency bands and mask, if the difference between the phases of signals of one and the other of channels in any of the frequency bands is smaller than a threshold value determined in advance, the sound signal in the frequency band to remove the center component from the sound signal.

The decision means may include a root decision section configured to decide, from the first feature quantity which represent energy levels of sounds of different tones in an order of the musical scale with reference to a reference sound which is a sound of a predetermined tone, whether or not the reference sound is a root, and a chord type decision section configured to decide at least whether the chord of the reference sound is a major chord or a minor chord from the first feature quantity.

The decision section may further include probability calculation means for calculating a probability that the reference sound is a root from a first discrimination function outputted from the route decision means and representative of a result of the decision regarding whether or not the reference sound is a root and calculating probabilities that the chord is a major chord and a minor chord from a second discrimination function outputted from the chord type decision means and representative of a result of decision regarding whether the chord is a major chord or a minor chord.

The signal processing apparatus may be configured such that the extraction means further extracts, from the sound signal from which the center component is not removed, second feature quantity representative of characteristics of sounds of different tones of the 12-tone equal temperament within the predetermined range, and the decision means uses the first and second feature quantity to decide the chord within the predetermined range.

In this instance, the decision means may include first root decision means for deciding, from the first feature quantity which represent energy levels of sounds of different tones in an order of the musical scale with reference to a first reference sound which is a sound of a predetermined tone, whether or not the first reference sound is a root, second root decision means for deciding, from the second feature quantity which represent energy levels of sounds of different tones in an order of the musical scale with reference to a second reference sound which is a sound of another predetermined tone, whether or not the second reference sound is a root, first chord type decision means for deciding at least whether the chord of the reference sound is a major chord or a minor chord from the first feature quantity, and second chord type decision means for deciding at least whether the chord of the reference sound is a major chord or a minor chord from the second feature quantity.

The decision means may further include probability calculation means for calculating a probability that the first reference sound is a root from a first discrimination function outputted from the first route decision means and representative of a result of the decision regarding whether or not the first reference sound is a root, calculating another probability that the second reference sound is a root from a second discrimination function outputted from the second route decision means and representative of a result of the decision regarding whether or not the second reference sound is a root, calculating probabilities that the chord is a major chord and a minor chord from a third discrimination function outputted from the first chord type decision means and representative of a result of decision regarding whether the chord is a major chord or a minor chord, and calculating probabilities that the chord is a major chord and a minor chord from a fourth discrimination function outputted from the second chord type decision means and representative of a result of decision regarding whether the chord is a major chord or a minor chord.

According to the embodiment of the present invention, there is further provided a signal processing method, including the steps of removing, from a sound signal in the form of a stereo signal, a center component which is a component of sound positioned at the center between the left and the right, extracting, from the sound signal from which the center component is removed, first feature quantity representative of characteristics of sounds of different tones of the 12-tone equal temperament within a predetermined range, and deciding a chord within the predetermined range using the first feature quantity.

According to the embodiment of the present invention, there is provided also a program for causing a computer to execute the steps of removing, from a sound signal in the form of a stereo signal, a center component which is a component of sound positioned at the center between the left and the right, extracting, from the sound signal from which the center component is removed, first feature quantity representative of characteristics of sounds of different tones of the 12-tone equal temperament within a predetermined range, and deciding a chord within the predetermined range using the first feature quantity.

According to the embodiment of the present invention, there is additionally provided a recording medium in or on which a program for causing a computer to execute a signal process is recorded, the signal process including the steps of removing, from a sound signal in the form of a stereo signal, a center component which is a component of sound positioned at the center between the left and the right, extracting, from the sound signal from which the center component is removed, first feature quantity representative of characteristics of sounds of different tones of the 12-tone equal temperament within a predetermined range, and deciding a chord within the predetermined range using the first feature quantity.

In the signal processing apparatus and method, program and recording medium, from a sound signal in the form of a stereo signal, a center component which is a component of sound positioned at the center between the left and the right is removed. Then, from the sound signal from which the center component is removed, feature quantity representative of characteristics of sounds of different tones of the 12-tone equal temperament within a predetermined range are extracted. Further, a chord within the predetermined range is decided using the feature quantity.

Therefore, with the signal processing apparatus and method, program and recording medium, a chord of a piece of music can be decided.

Further, a root of a chord of a piece of music can be decided accurately from a sound signal of the piece of music.

DETAILED DESCRIPTION OF THE PREFERRED EMBODIMENTS

Before preferred embodiments of the present invention are described in detail, a corresponding relationship between several features set forth in the accompanying claims and particular elements of the preferred embodiments described below is described. The description, however, is merely for the confirmation that the particular elements which support the invention as set forth in the claims are disclosed in the description of the embodiment of the present invention. Accordingly, even if some particular element which is set forth in description of the embodiments is not set forth as one of the features in the following description, this does not signify that the particular element does not correspond to the feature. On the contrary, even if some particular element is set forth as an element corresponding to one of the features, this does not signify that the element does not correspond to any other feature than the element.

Figure 1:
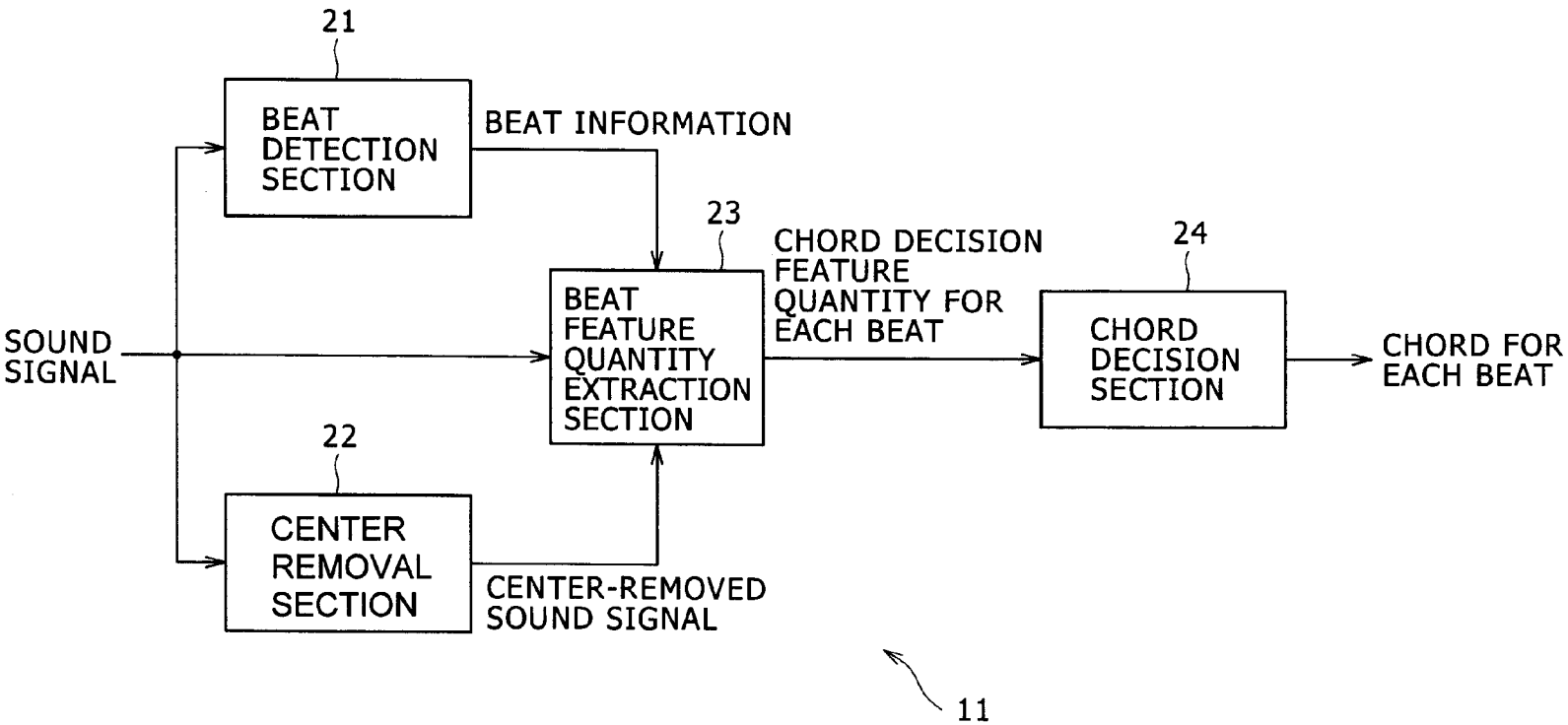
FIG. 1 is a block diagram showing a configuration of a signal processing apparatus to which the present invention is applied.

According to an embodiment of the present invention, there is provided a signal processing apparatus including removal means (for example, a center removal section 22 shown in FIG. 1) for removing, from a sound signal in the form of a stereo signal, a center component which is a component of sound positioned at the center between the left and the right, extraction means (for example, a beat feature quantity extraction section 23 shown in FIG. 1) for extracting, from the sound signal from which the center component is removed, first feature quantity representative of characteristics of sounds of different tones of the 12-tone equal temperament within a predetermined range, and decision means (for example, a chord decision section 24 shown in FIG. 1) for deciding a chord within the predetermined range using the first feature quantity.

The signal processing apparatus may further include detection means (for example, a beat detection section 21 shown in FIG. 1) for detecting the position of each of beats from the sound signal, the extraction means extracting the first feature quantity within a range of each of the beats of the sound signal which is the predetermined range, the decision means deciding a chord within the range of the beat using the first feature quantity.

The decision means may include root decision means (for example, a root decision section 62 shown in FIG. 11) for deciding, from the first feature quantity which represent energy levels of sounds of different tones in an order of the musical scale with reference to a reference sound which is a sound of a predetermined tone, whether or not the reference sound is a root, and chord type decision means (for example, a major/minor decision section 63 shown in FIG. 11) for deciding at least whether the chord of the reference sound is a major chord or a minor chord from the first feature quantity.

The decision means may further include probability calculation means (for example, a probability calculation section 66 shown in FIG. 11) for calculating a probability that the reference sound is a root from a first discrimination function outputted from the route decision means and representative of a result of the decision regarding whether or not the reference sound is a root and calculating probabilities that the chord is a major chord and a minor chord from a second discrimination function outputted from the chord type decision means and representative of a result of decision regarding whether the chord is a major chord or a minor chord.

The decision means may include first root decision means (for example, a root decision section 62 shown in FIG. 11) for deciding, from the first feature quantity which represent energy levels of sounds of different tones in an order of the musical scale with reference to a first reference sound which is a sound of a predetermined tone, whether or not the first reference sound is a root, second root decision means (for example, a root decision section 64 shown in FIG. 11) for deciding, from the second feature quantity which represent energy levels of sounds of different tones in an order of the musical scale with reference to a second reference sound which is a sound of another predetermined tone, whether or not the second reference sound is a root, first chord type decision means (for example, a major/minor decision section 63 shown in FIG. 11) for deciding at least whether the chord of the reference sound is a major chord or a minor chord from the first feature quantity, and second chord type decision means (for example, a major/minor decision section 65 shown in FIG. 11) for deciding at least whether the chord of the reference sound is a major chord or a minor chord from the second feature quantity.

The decision means may further include probability calculation means (for example, a probability calculation section 66 shown in FIG. 11) for calculating a probability that the first reference sound is a root from a first discrimination function outputted from the first route decision means and representative of a result of the decision regarding whether or not the first reference sound is a root, calculating another probability that the second reference sound is a root from a second discrimination function outputted from the second route decision means and representative of a result of the decision regarding whether or not the second reference sound is a root, calculating probabilities that the chord is a major chord and a minor chord from a third discrimination function outputted from the first chord type decision means and representative of a result of decision regarding whether the chord is a major chord or a minor chord, and calculating probabilities that the chord is a major chord and a minor chord from a fourth discrimination function outputted from the second chord type decision means and representative of a result of decision regarding whether the chord is a major chord or a minor chord.

Figure 12:
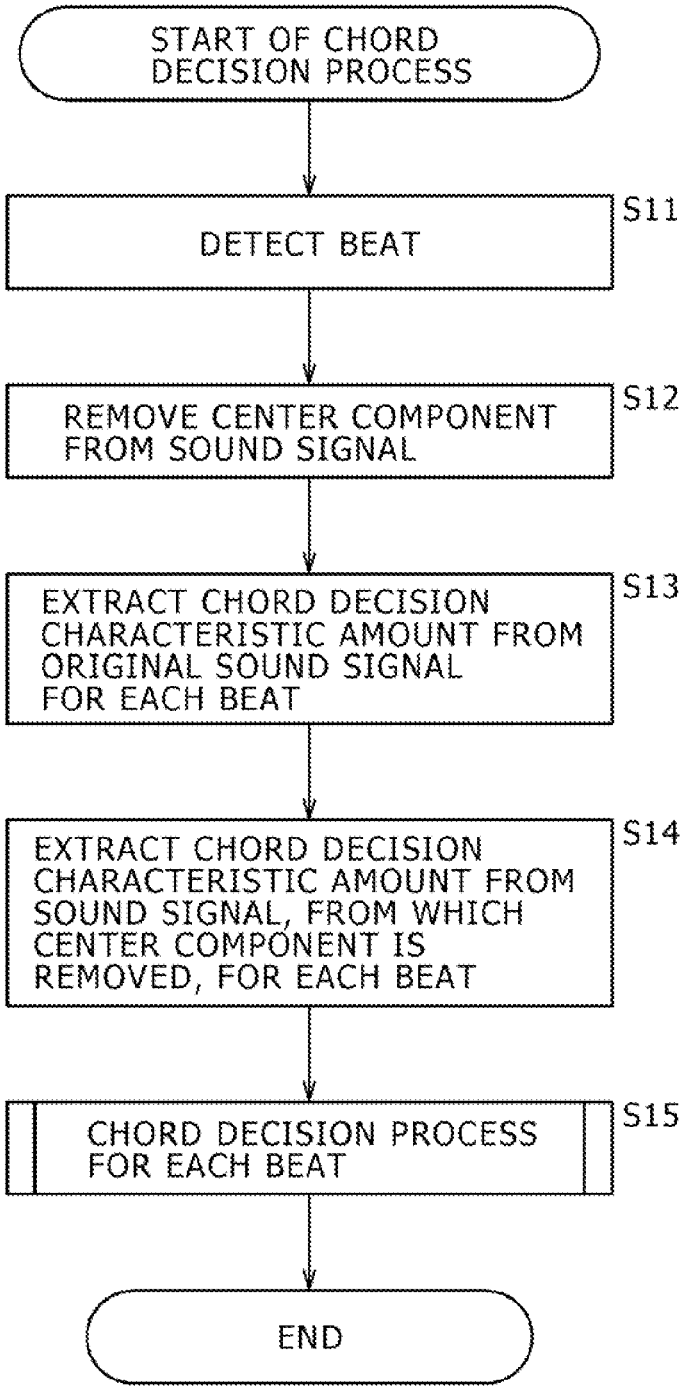
FIG. 12 is a flow chart illustrating a chord decision process.

According to the embodiment of the present invention, there are further provided a signal processing method and a program including the steps of removing, from a sound signal in the form of a stereo signal, a center component which is a component of sound positioned at the center between the left and the right (for example, a process at step S12 of FIG. 12), extracting, from the sound signal from which the center component is removed, first feature quantity representative of characteristics of sounds of different tones of the 12-tone equal temperament within a predetermined range (for example, a process at step S14 of FIG. 12), and deciding a chord within the predetermined range using the first feature quantity (for example, a process at step S15 of FIG. 12).

Referring to FIG. 1, there is shown a configuration of a signal processing apparatus to which the present invention is applied. The signal processing apparatus 11 shown includes a beat detection section 21, a center removal section 22, a beat feature quantity extraction section 23 and a chord decision section 24.

A sound signal in the form of a stereo signal representative of a piece of music inputted to the signal processing apparatus 11 is supplied to the beat detection section 21, center removal section 22 and beat feature quantity extraction section 23.

The beat detection section 21 detects a beat from the sound signal of the piece of music.

The beat is a beat point or a meter and is a reference which sounds as a basic unit in a piece of music. Although the term beat is generally used in a plurality of significances, in the following description, it is used so as to signify the time at a start of a basic unit of a period of time in a piece of music.

The time at the start of a basic unit of a period of time in a piece of music is referred to as position of the beat, and the range of the basic unit of a period of time in a piece of music is referred to as range of the beat. It is to be noted that the length of the beat is a tempo.

In particular, the beat detection section 21 detects the position of a beat of a sound signal of a piece of music from the sound signal of a piece of music. The beat detection section 21 supplies beat information representative of the position of each of beats of the sound signal to the beat feature quantity extraction section 23.

It is to be noted that, since the interval from the position of a beat to the position of a next beat in a sound signal is a range of a beat, if the positions of beats in the sound signal are detected, then the range of the beats can be detected.

The center removal section 22 removes, from the sound signal in the form of a stereo signal, a center component which is a component of sound positioned at the center between the left and the right. The center removal section 22 supplies the sound signal from which the center component is removed (such sound signal is hereinafter referred to as center-removed sound signal) to the beat feature quantity extraction section 23.

The beat feature quantity extraction section 23 extracts a feature quantity of sound within a predetermined range from the sound signal. For example, the beat feature quantity extraction section 23 extracts feature quantity of sound for each beat from the sound signal (such feature quantity are hereinafter referred to as chord decision feature quantity for each beat). In particular, the beat feature quantity extraction section 23 extracts feature quantity individually representative of characteristics of sounds of different tones of the 12-tone equal temperament within a range of each of beats of the sound signal based on beat information.

More particularly, the beat feature quantity extraction section 23 extracts feature quantity representative of characteristics of sounds of different tones of the 12-tone equal temperament within a predetermined range from the center-removed sound signal based on beat information. The beat feature quantity extraction section 23 further extracts feature quantity representative of characteristics of sounds of different tones of the 12-tone equal temperament within a predetermined range from the original sound signal from which the center component is removed based on beat information. For example, the beat feature quantity extraction section 23 extracts feature quantity individually representative of characteristics of sounds of the tones of the 12-tone equal temperament within the ranges of individual beats of the sound signal from the center-removed sound signal based on beat information. The beat feature quantity extraction section 23 further extracts feature quantity indicative of characteristics of the sounds of the 12-tone equal temperament within the ranges of the beats of the sound signal from the original sound signal from which the center component is not removed.

The beat feature quantity extraction section 23 supplies the chord decision feature quantity for each beat including the feature quantity extracted from the center-removed sound signal and the feature quantity extracted from the original sound signal from which the center component is not removed to the chord decision section 24.

The chord decision section 24 decides a chord for each beat from the chord discrimination feature quantity for each beat supplied thereto from the beat feature quantity extraction section 23 and outputs the chord. In other words, the chord decision section 24 decides a chord within the range of a beat from the chord discrimination feature quantity for each beat.

It is to be noted that the chord decision section 24 is produced in advance by learning based on feature quantity as hereinafter described.

In this manner, the signal processing apparatus 11 decides, from a sound signal of a piece of music, a chord for each beat.

Figure 2:
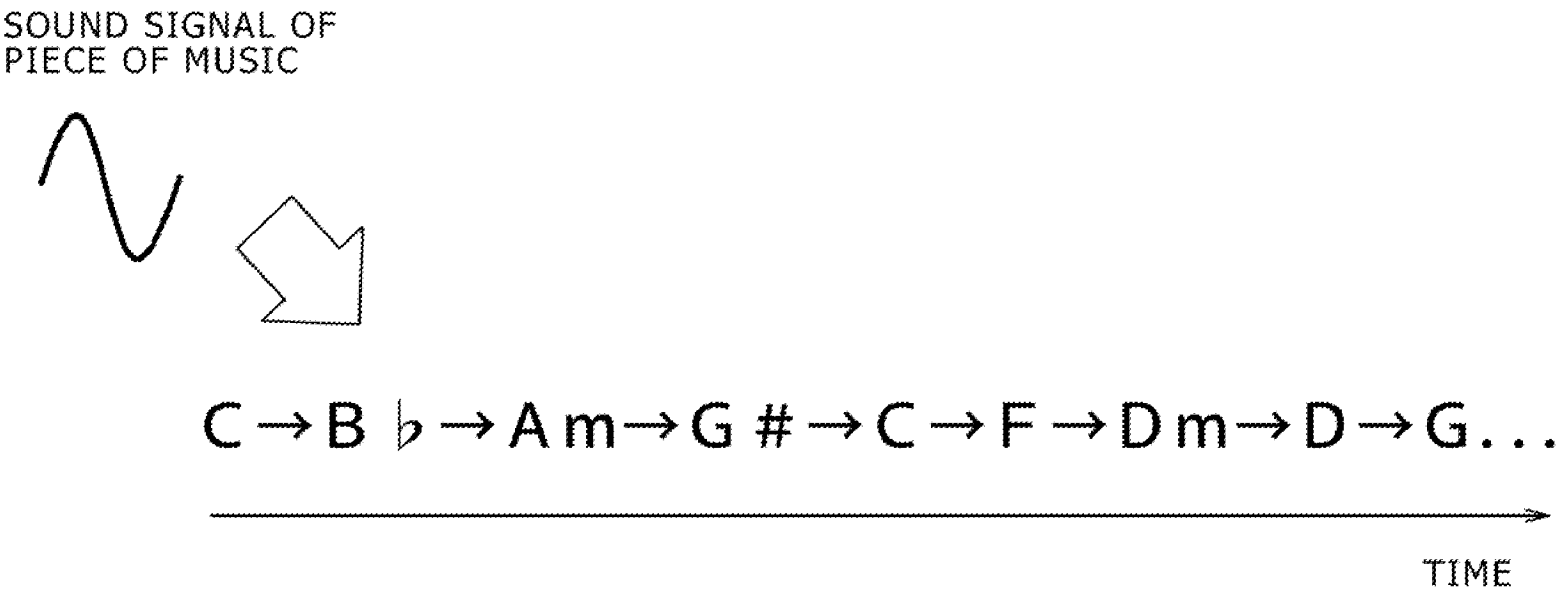
FIG. 2 is a view illustrating an example of chords decided from a sound signal.

For example, as seen in FIG. 2, the signal processing apparatus 11 decides a chord of C, a chord of B flat, a chord of A miner, a chord of G sharp, a chord of G, a chord of C, a chord of F, a chord of D miner, a chord of D, a chord of G and so forth for each beat from the sound signal of a piece of music. For example, the signal processing apparatus 11 decides the chord name of a chord for each beat and outputs the chord name of the chord for each beat.

Figure 3:
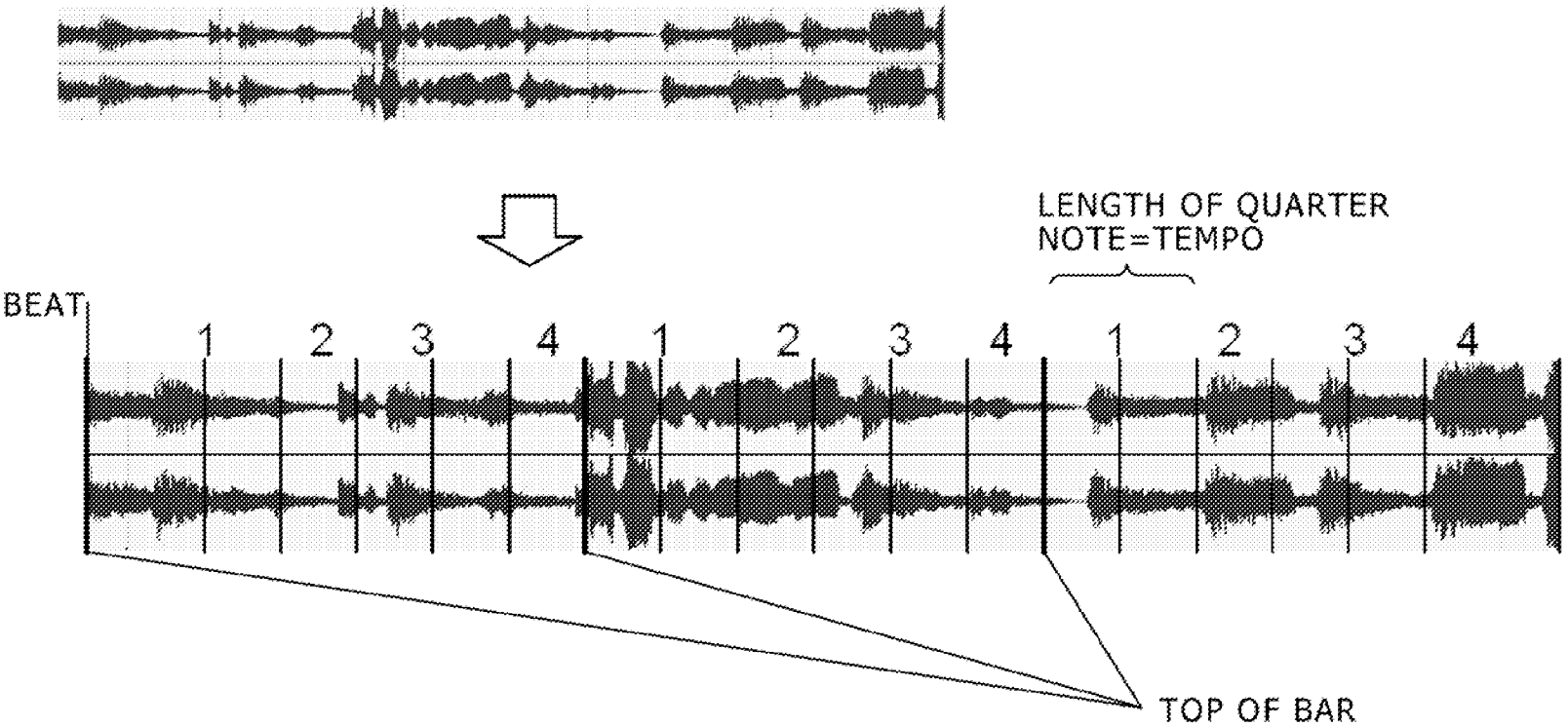
FIG. 3 is a view illustrating an example of detection of a beat from a sound signal.

First, description is given of the beat detection section 21 which detects the position of each beat, that is each meter, from the sound signal as seen in FIG. 3. Referring to FIG. 3, a vertical line corresponding to each of numerals of "1 2 3 4 1 2 3 4 1 2 3 4" indicates the position of a beat of the sound signal. The range from the position indicated by a vertical line corresponding to each of numerals of "1 2 3 4 1 2 3 4 1 2 3 4" to the position of a next vertical line indicates a range of the beat of the sound signal.

It is to be noted that the length indicated by two adjacent vertical lines indicates, for example, the length of a quarter note and corresponds to a tempo. Meanwhile, the position indicated by a vertical line corresponding to the numeral "1" indicates the top of a bar.

Figure 4:
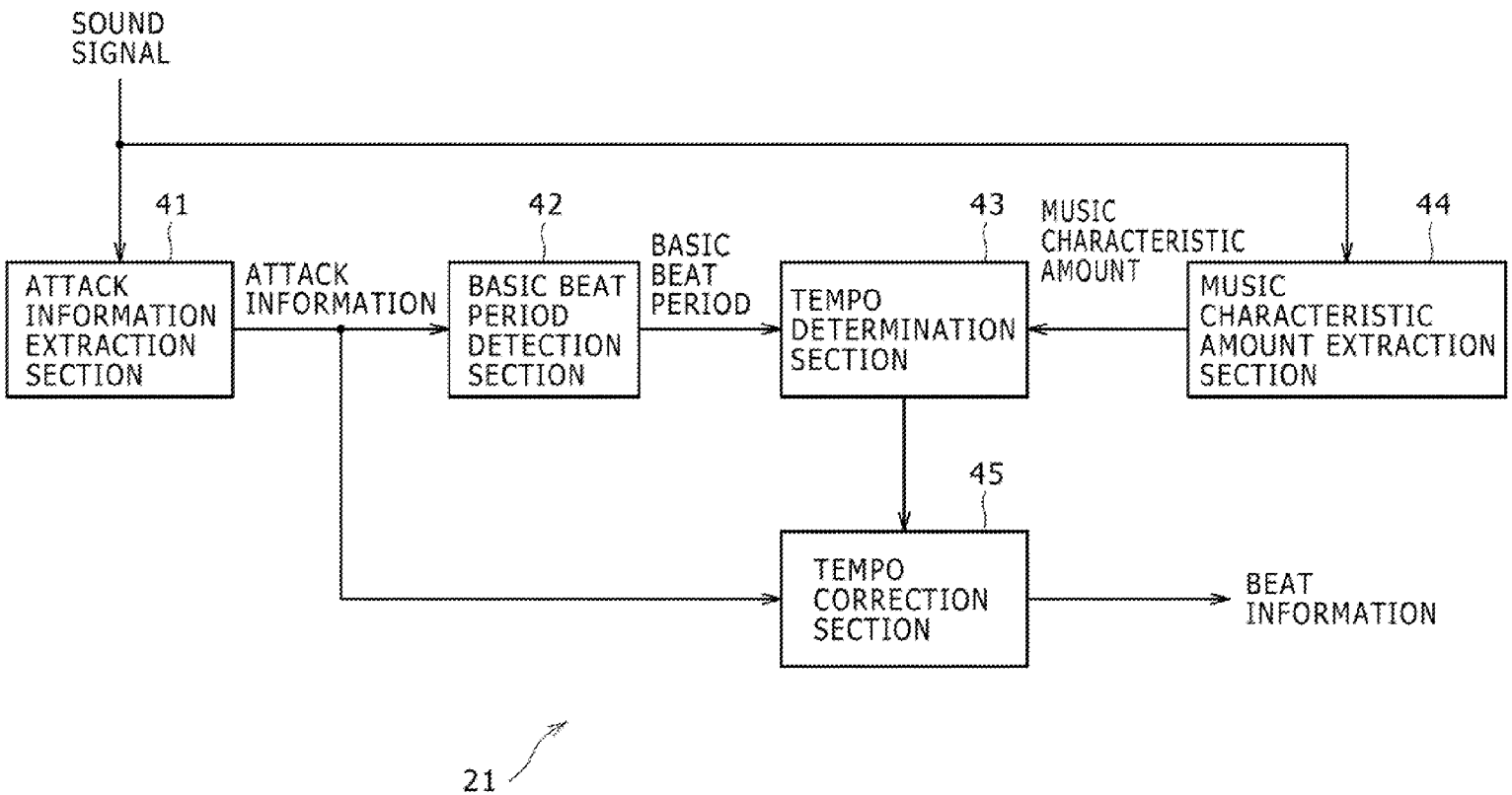
FIG. 4 is a block diagram showing an example of a configuration of a beat detection section.

FIG. 4 shows an example of a configuration of the beat detection section 21. Referring to FIG. 4, the beat detection section 21 includes an attack information extraction section 41, a basic beat period detection section 42, a tempo determination section 43, a music feature quantity extraction section 44 and a tempo correction section 45.

Figure 5:
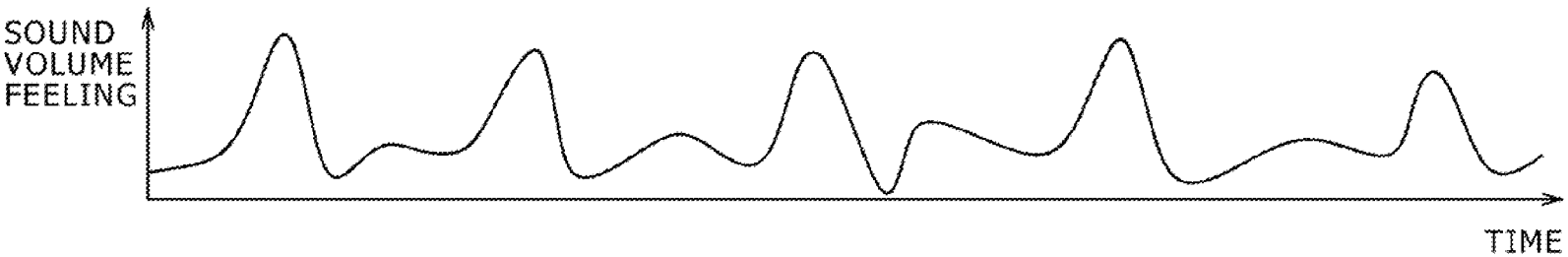
FIG. 5 is a graph illustrating an example of attack information.

The attack information extraction section 41 extracts attack information of a time series from a sound signal indicating a waveform of a piece of music. Here, the attack information of a time series is data into which a variation of the sound volume depending upon which a human being feels a beat is converted along the time. As seen in FIG. 5, the attack information is represented by a sound volume feeling indicative of the sound volume felt by a human being.

For example, the attack information extraction section 41 extracts attack information indicative of the level of sound by the sound signal at each point of time from the sound signal.

Figure 6:
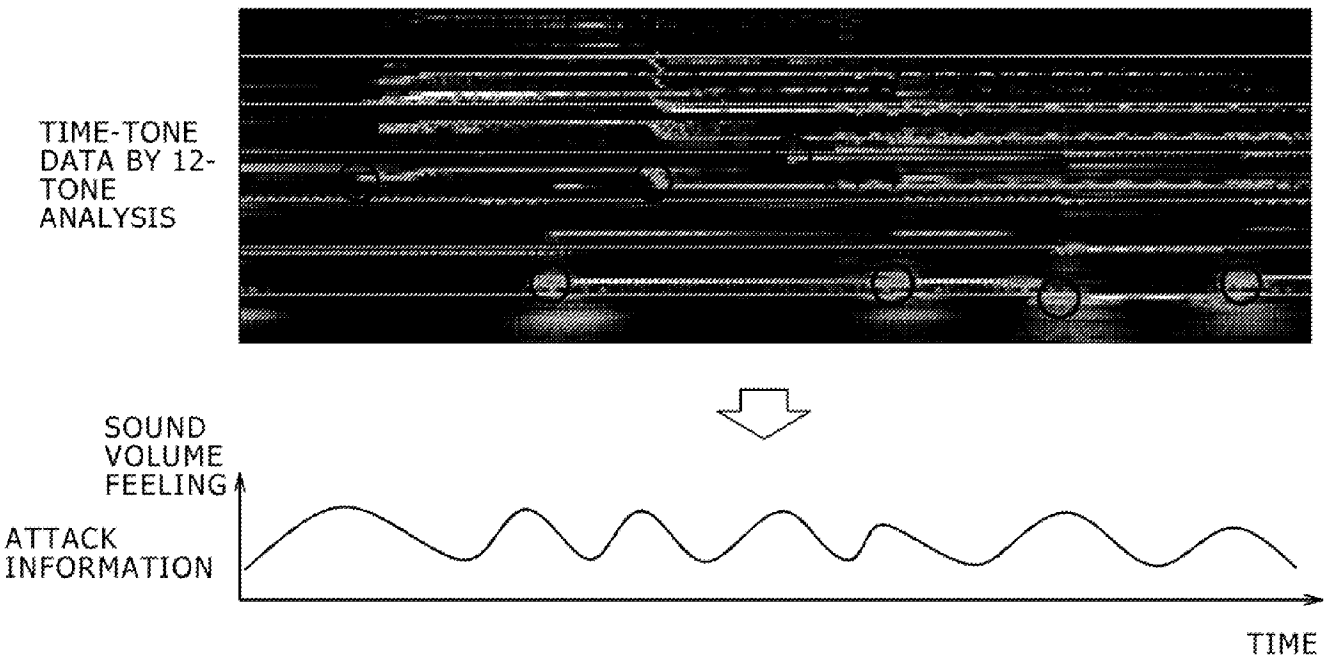
FIG. 6 is a view illustrating another example of attack information.

For example, as seen in FIG. 6, the attack information extraction section 41 divides sounds of the sound signal into components of a plurality of octaves and determines the energy level of each of 12 sounds of different tones of the 12-tone equal temperament in the individual octaves to determine time-tone data by 12-tone analysis individually indicative of the energy levels of the 12 sounds for each octave. The attack information extraction section 41 integrates the sound energy levels of the 12 sounds of the plural octaves at each point of time and uses a result of the integration as attack information.

Further, for example, the attack information extraction section 41 divides a sound of the sound signal into components of a plurality of octaves and detects the timing at the start of sounding of the 12 sounds of the different tones of the 12-tone equal temperament in the individual octaves. For example, if the difference in energy level in the time direction of each sound is higher than a threshold value, then the attack information extraction section 41 decides the point of time as the start of sounding of the sound.

Then, the attack information extraction section 41 allocates 1 to the start of sounding of a sound and allocates 0 to any other point of time and integrates the values of 1 and 0 for the 12 sounds over the plural octaves. Thus, the attack information extraction section 41 determines a result of the integration as attack information.

In FIG. 6, a round mark indicates the position of the start of sounding of a sound. Where 1 is set to the start of sounding of a sound and 0 is set to any other position and such values are integrated to determine attack information, the attack information exhibits a high value if the start of sounding is indicated by a comparatively great number of ones of the 12 sounds over the plurality of octaves, but exhibits a low value if the start of sounding is indicated by a comparatively small number of ones of the 12 sounds over the plurality of octaves.

Further, the attack information extraction section 41 divides a sound of the sound signal into components of a plurality of octaves and determines the variation in energy level of each of the 12 sounds of the different tones of the 12-tone equal temperament within the individual octaves. For example, the variation in energy level of sound is calculated as a difference in energy of sound in the time direction. The attack information extraction section 41 integrates the variation in energy level of sound at each point of time for the 12 sounds within the individual octaves and determines a result of the integration as attack information.

The attack information extraction section 41 supplies such attack information as described above to the basic beat period detection section 42 and the tempo correction section 45.

The basic beat period detection section 42 detects the length of the most basic sound in a piece of music of an object of detection of a chord. For example, the most basic sound in a piece of music is sound represented by a quarter note, a quaver or a semiquaver.

In the following description, the length of the most basic sound in a piece of music is referred to basic beat period.

The basic beat period detection section 42 compares the attack information in the form of time series information to an ordinary waveform to perform basic pitch (tone) extraction to determine a basic beat period.

Figure 7:
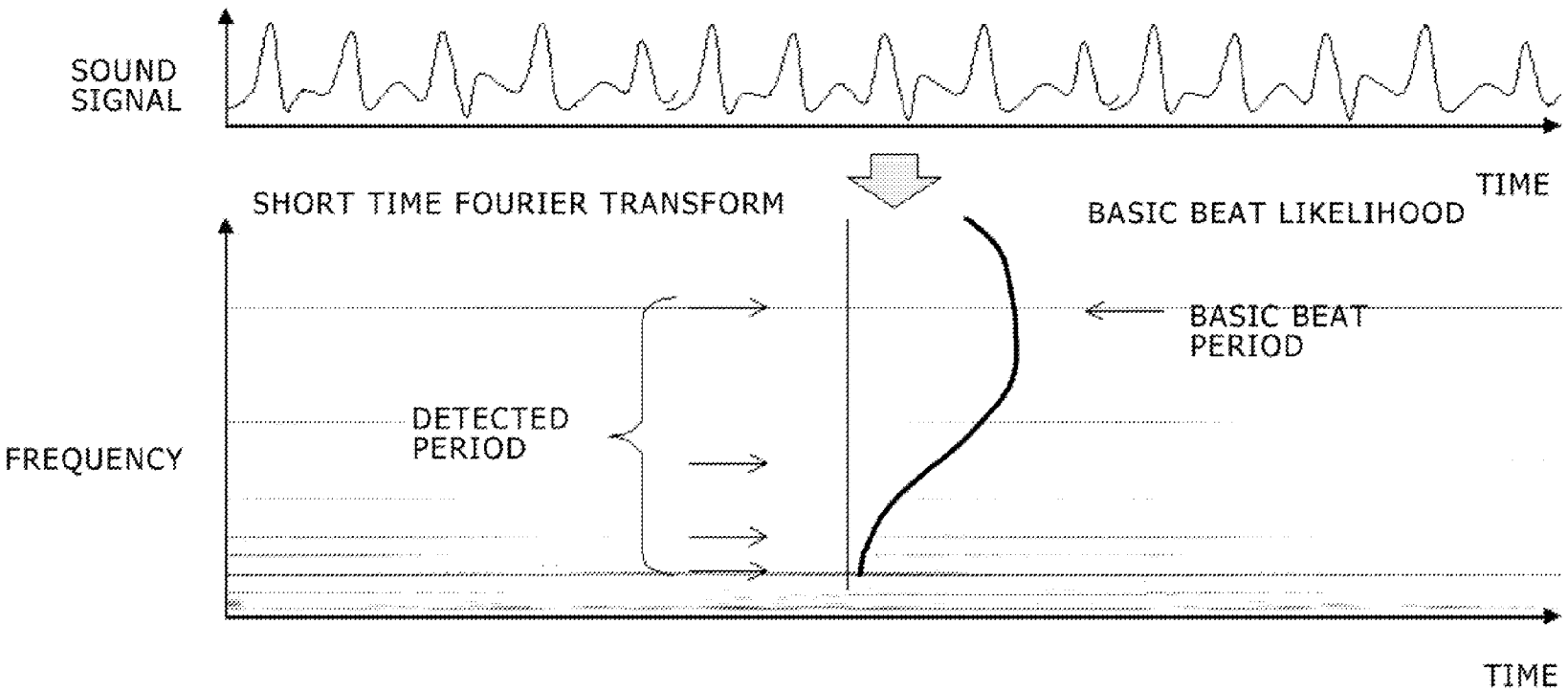
FIG. 7 is a view illustrating a basic beat period.

For example, the basic beat period detection section 42 performs short time Fourier transform of the attack information in the form of time series information as seen in FIG. 7. As a result of the short time Fourier transform of the attack information, a result which indicates the intensity of energy at each frequency in a time series is obtained.

In particular, while the basic beat period detection section 42 successively displaces the position of a window which is a period sufficiently shorter than the time length of the attack information with respect to the attack information, the basic beat period detection section 42 Fourier transforms a portion of the attack information in the window. Then, the basic beat period detection section 42 arranges results of the Fourier transform in a time series to determine a result which indicates the intensity of energy at the individual frequencies in a time series.

As a result of the short time Fourier transform, a frequency of an energy level higher than those of the other frequencies is detected as a period as a candidate to a basic beat period. At a lower portion of FIG. 7, the concentration indicates the intensity of energy.

The basic beat period detection section 42 determines the most prominent one of periods detected as a result of the short time Fourier transform of the attack information as a basic beat period.

In particular, the basic beat period detection section 42 refers to a basic beat likelihood which is a weight prepared in advance and results of short time Fourier transform of the attack information to determine that one of the periods detected as a result of the short time Fourier transform of the attack information which has a high basic beat likelihood as a basic beat period.

More particularly, the basic beat period detection section 42 weights the energy levels for the individual frequencies obtained as a result of the short time Fourier transform of the attack information with basic beat likelihoods which are weights in the frequency direction determined in advance and determines that frequency with regard to which the highest value is exhibited from among values obtained by the weighting as a basic beat period.

By the use of the basic beat likelihood which is a weight in the frequency direction, the period of a very low frequency or a very high frequency which may not be a basic beat period can be prevented from being determined as a basic beat period.

The basic beat period detection section 42 supplies a basic beat period extracted in this manner to the tempo determination section 43.

The music feature quantity extraction section 44 applies a predetermined signal process to the sound signal to extract a predetermined number of feature quantity (hereinafter referred to as music feature quantity) from a piece of music. For example, the music feature quantity extraction section 44 divides the sound signal into components of a plurality of octaves and determines signals of 12 sounds of the different tones of the 12-tone equal temperament in the individual octaves. Then, the music feature quantity extraction section 44 applies a predetermined signal process to the signals of the 12 sounds in the individual octaves to extract music feature quantity.

For example, the music feature quantity extraction section 44 determines the number of peaks per unit time of each of the signals of the 12 sounds in the individual octaves as the music feature quantity.

Further, the music feature quantity extraction section 44 determines, for example, the dispersion of energy in the musical interval direction of the signal of the 12 sounds in the octaves as music characteristic signals.

Furthermore, the music feature quantity extraction section 44 decides, for example, the balance in energy among the low, middle and high frequency regions from the signal of the 12 sounds in the individual octaves as music feature quantity.

Further, the music feature quantity extraction section 44 decides, for example, the magnitude of the correlation between signals of the left and right channels of the stereo sound signals from the signal of the 12 sounds in the individual octaves as music feature quantity.

The music feature quantity extraction section 44 supplies music feature quantity extracted in this manner to the tempo determination section 43.

The tempo determination section 43 is constructed by learning of the music feature quantity and the tempo in advance and estimates the tempo from the music feature quantity supplied from the music feature quantity extraction section 44. The tempo obtained by the estimation is hereinafter referred to as estimated tempo.

The tempo determination section 43 determines, based on the estimated tempo and the basic beat period supplied from the basic beat period detection section 42, the tempo from among multiples of the basic beat period by 2× ( . . . , ⅛ time, ¼ time, ½ time, one time, 2 times, 4 times, 8 times, . . . ). For example, a value obtained by multiplying the basic beat period by 2 or ½ so that the value may remain within the range between the estimated tempo$\times 2^{1/2}$ and the estimated tempo$\div 2^{1/2}$ where the estimated tempo is obtained by estimation by regression analysis from the feature quantity of the piece of music is determined as the tempo.

Figure 8:
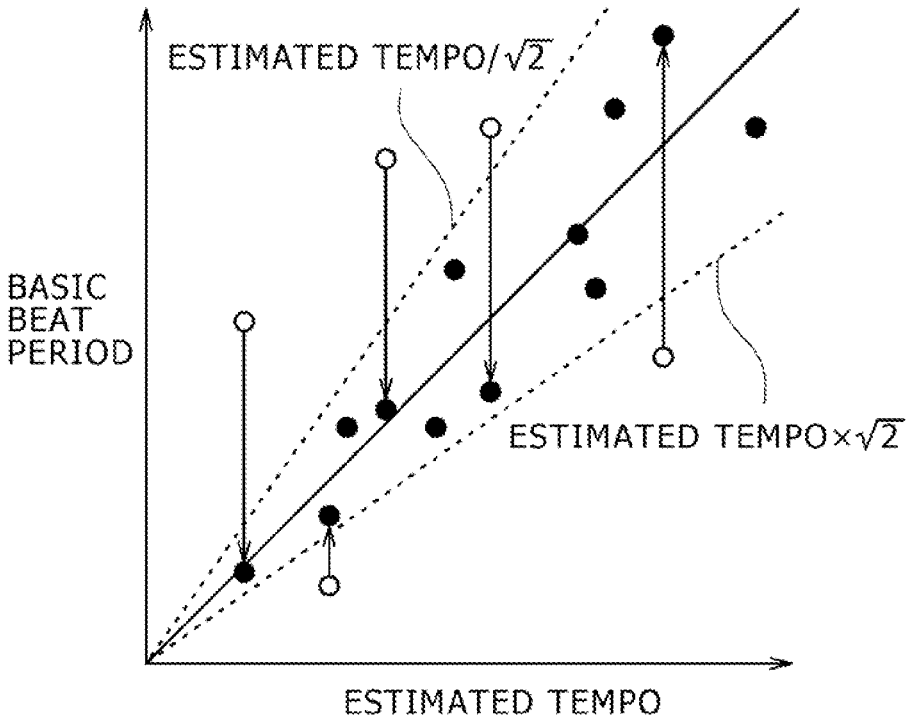
FIG. 8 is a view illustrating determination of a tempo.

For example, as seen in FIG. 8, the tempo determination section 43 compares the basic beat period supplied from the basic beat period detection section 42 and the period determined by the estimated tempo$\div 2^{1/2}$ with each other. Then, if the basic beat period (basic beat period indicated by a blank circle at an upper portion of FIG. 8) is longer than the period determined by the estimated tempo$\div 2^{1/2}$, then the tempo determination section 43 multiplies the basic beat period by ½.

Further, the tempo determination section 43 compares the basic beat period supplied from the basic beat period detection section 42 and the period determined by the estimated tempo$\times 2^{1/2}$ with each other. Then, if the basic beat period (basic beat period indicated by a blank circle at a lower portion of FIG. 8) is shorter than the period determined by the estimated tempo$\times 2^{1/2}$, then the tempo determination section 43 multiplies the basic beat period by 2.

The tempo determination section 43 determines the basic beat period (basic beat period indicated by a solid circle in FIG. 8) after multiplied by ½ or 2 or repetitively multiplied by ½ or 2 until the resulting value comes within the range between the estimated tempo$\times 2^{1/2}$ and the estimated tempo$\div 2^{1/2}$ as the tempo.

It is to be noted that, where the basic beat period remains within the range between the estimated tempo$\times 2^{1/2}$ and the estimated tempo$\div 2^{1/2}$, the tempo determination section 43 determines the basic beat period as it is as the tempo.

The tempo determination section 43 supplies the tempo determined in this manner to the tempo correction section 45.

The tempo correction section 45 corrects the tempo determined by the tempo determination section 43 finely with the attack information.

In particular, the tempo correction section 45 first corrects the phase of the beat.

Figure 9:
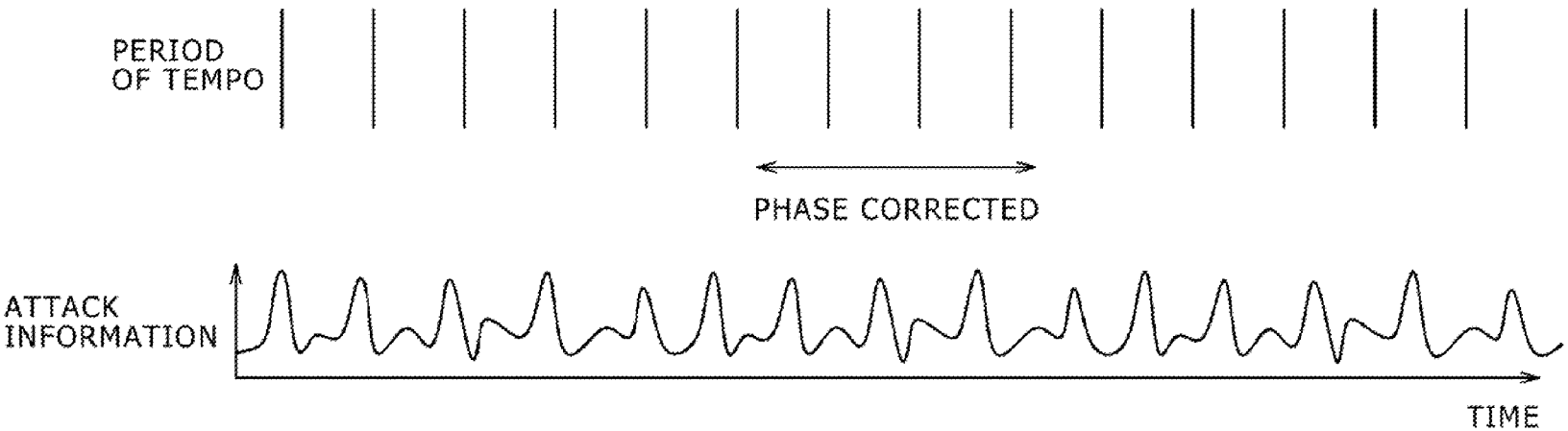
FIG. 9 is a view illustrating correction of the phase of a beat.

In particular, as seen in FIG. 9, the tempo correction section 45 sums the attack information over the entire piece of music for each range of a beat in a period of the tempo determined for the attack information.

For example, the tempo correction section 45 sums the first samples of the attack information in the individual ranges of the first to last beats determined in the period of the tempo over the entire piece of music. Then, the tempo correction section 45 determines a result of the summing as a first sum value within the range of the beats. Then, the tempo correction section 45 sums the second samples of the attack information in the individual ranges of the first to last beats determined in the period of the tempo over the entire piece of music. Then, the tempo correction section 45 determines a result of the summing as a second sum value within the range of the beats.

Similarly, the tempo correction section 45 sums each of the third to last samples of the attack information in the individual ranges of the first to last beats determined in the period of the tempo over the entire piece of music. Then, the tempo correction section 45 determines results of the summing individually as first to last sum values within the range of the beats.

Then, the tempo correction section 45 displaces the phase of the period of the tempo with respect to the attack information and sums the attack information over the entire piece of music for each of ranges of the beats similarly.

The tempo correction section 45 corrects the phase of the period of the tempo with respect to the attack information to the phase with which that one of the sum values obtained by displacing the phase of the period of the tempo with respect to the attack information which exhibits the highest value is obtained. In other words, the tempo correction section 45 corrects the position of a beat to the position of the period of the tempo with respect to the attack information with which the highest sum value is obtained.

Further, the tempo correction section 45 corrects the tempo.

Figure 10:
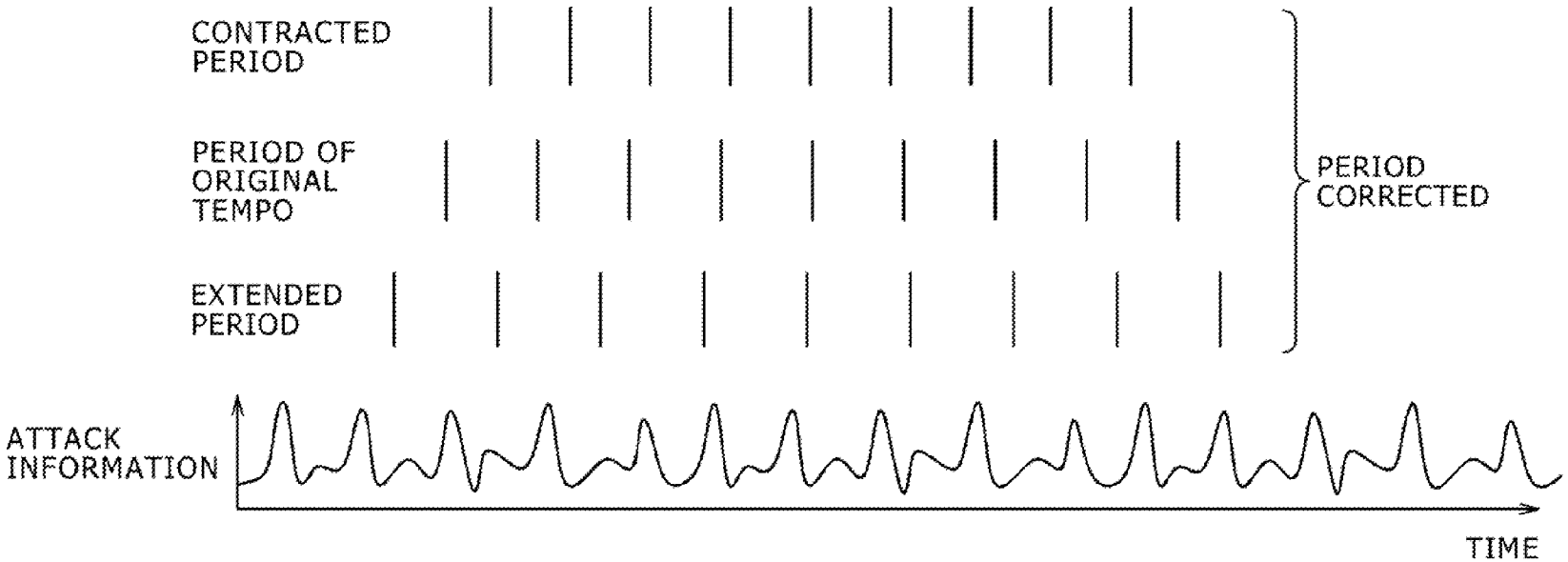
FIG. 10 is a view illustrating correction of the tempo.

In particular, as seen in FIG. 10, the tempo correction section 45 contracts or extends the period of the tempo by a predetermined length which is sufficiently shorter than the period and then sums the attack information for each period of the tempo in a period of the contracted or extended tempo over the entire piece of music.

Also in this instance, the tempo correction section 45 sums the first to last samples of the attack information in the individual ranges of the first to last beats determined in the period of the tempo over the entire piece of music. Then, the tempo correction section 45 determines results of the summing individually as first to last sum values within the range of the beats.

The tempo correction section 45 contracts or extends the period of the tempo by a predetermined length and sums the attack information over the entire piece of music for each period of the contracted or extended tempo to determine first to last sum values within the range of the beats.

The tempo correction section 45 corrects the period of the tempo to the length with which the highest sum value is obtained from among the original length and the lengths of the periods of the contracted and extended tempos.

The tempo correction section 45 repeats such correction of the phase of a beat and correction of the tempo as described above as occasion demands to determine a final tempo. For example, the tempo correction section 45 repeats the correction of the phase of the beat and the correction of the tempo by a predetermined number of times, for example, two times, to determine a final tempo.

The tempo correction section 45 outputs beat information representative of the finally determined tempo.

In this manner, the beat detection section 21 detects the position of each beat from the sound signal and outputs beat information representative of the positions of the beats in the sound signal.

Now, a configuration of the chord decision section 24 is described.

Figure 11:
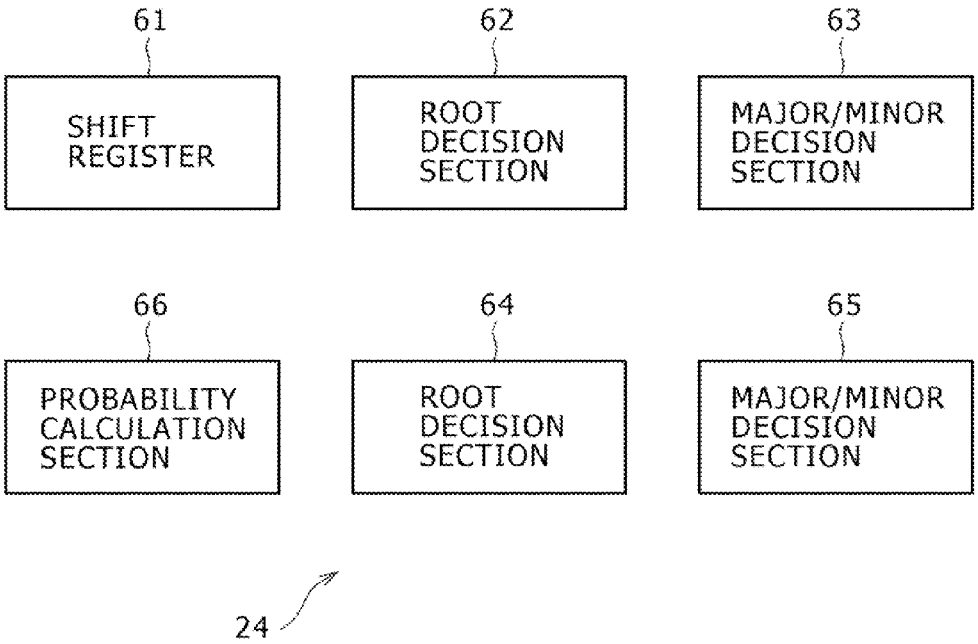
FIG. 11 is a block diagram showing an example of a configuration of a chord decision section.

FIG. 11 shows an example of the configuration of the chord decision section 24. Referring to FIG. 11, the chord decision section 24 shown includes a shift register 61, a root decision section 62, a major/minor decision section 63, a root decision section 64, a major/minor decision section 65 and a probability calculation section 66.

The shift register 61 shifts the feature quantity so as to change the reference sound for the feature quantity to a different sound. This is because the chord decision feature quantity for each beat supplied from the beat feature quantity extraction section 23 include feature quantity extracted from the center-removed sound signal and feature quantity extracted from the original sound signal from which the center component is not removed and the feature quantity extracted from the center-removed sound signal and the feature quantity extracted from the original sound signal from which the center component is not removed indicate the energy levels of sounds of the different tones in the order of the musical scale with reference to the reference sounds which are sounds of predetermined tones with regard to the sounds of the different tones of the 12-tone equal temperament within the range of each of the beats of the sound signal.

The shift register 61 supplies feature quantity shifted so as to change the reference sounds for the feature quantity to different sounds to the root decision section 62, major/minor decision section 63, root decision section 64 and major/minor decision section 65.

The root decision section 62 decides whether or not a reference sound is a root from the feature quantity extracted from the center-removed sound signal from among the chord decision feature quantity for each beat. More particularly, the root decision section 62 decides, from the feature quantity extracted from the center-removed sound signal from among the chord decision feature quantity for each beat supplied from the beat feature quantity extraction section 23, whether or not the reference sound of each of the feature quantity is a root. Further, the root decision section 62 decides, from the feature quantity extracted from the center-removed sound signal and shifted so as to change each reference sound to a different sound by the shift register 61, whether or not the reference sound of the shifted feature quantity is a root.

For example, the root decision section 62 outputs a discrimination function for deciding whether or not a reference sound is a root.

The major/minor decision section 63 decides, from the feature quantity extracted from the center-removed sound signal from among the chord decision feature quantity for each beat, whether the chord is a major chord or a minor chord. More particularly, the major/minor decision section 63 decides, from the feature quantity extracted from the center-removed sound signal from among the chord decision feature quantity for each beat supplied from the beat feature quantity extraction section 23, whether the chord within a range of a beat from which the feature quantity are extracted is a major chord or a minor chord. Further, the major/minor decision section 63 decides, from the feature quantity extracted from the center-removed sound signal and shifted so as to change each reference sound to another sound by the shift register 61, whether the chord within the range of the beat from which the feature quantity before the reference sound is shifted are extracted is a major chord or a minor chord.

For example, the major/minor decision section 63 outputs a discrimination function for deciding whether the chord is a major chord or a minor chord.

The root decision section 64 decides, from the feature quantity extracted from the original sound signal from which the center component is not removed from among the chord decision feature quantity for each beat, whether or not the reference sound is a root. More particularly, the root decision section 64 decides, from the feature quantity extracted from the original sound signal from which the center component is not removed from among the chord decision feature quantity for each beat supplied from the beat feature quantity extraction section 23, whether or not the reference sound of the feature quantity is a root. Further, the root decision section 64 decides, from the feature quantity extracted from the original sound signal from which the center component is not removed and shifted so as to change each reference sound to a different sound, whether or not the reference sound of the shifted feature quantity is a root.

For example, the root decision section 64 outputs a discrimination function for discriminating whether or not a reference sound is a root.

The major/minor decision section 65 decides, from the feature quantity extracted from the original sound signal from which the center component is not removed from among the chord decision feature quantity for each beat, whether a chord is a major chord or a minor chord. More particularly, the major/minor decision section 65 decides, from the feature quantity extracted from the original sound signal from which the center component is not removed from among the chord decision feature quantity for each beat supplied from the beat feature quantity extraction section 23, whether the chord within the range of the beat from which the feature quantity are extracted is a major chord or a minor chord. Further, the major/minor decision section 65 decides, from the feature quantity extracted from the original sound signal from which the center component is not removed and shifted so as to change the reference sound to a different sound, whether the chord within the range of the beat from which the feature quantity before the shifting is extracted is a major chord or a minor chord.

For example, the major/minor decision section 65 outputs a discrimination function for deciding whether a chord is a major chord or a minor chord.

The probability calculation section 66 calculates, from the discrimination function outputted from the root decision section 62 or the discrimination function outputted from the root decision section 64, the probability that the reference sound is a root. Further, the probability calculation section 66 calculates, from the discrimination function outputted from the major/minor decision section 63 or the discrimination function outputted from the major/minor decision section 65, the probability that the chord is a major chord and the probability that the chord is a minor chord.

The chord decision section 24 decides a final chord from the probability that the reference sound is a root, the probability that the chord is a major chord and the probability that the chord is a minor chord, and outputs the decided final chord.

Now, a process for chord decision by the signal processing apparatus 11 is described with reference to a flow chart of FIG. 12. First at step S11, the beat detection section 21 detects a beat. In particular, at step S11, the beat detection section 21 performs the process described hereinabove with reference to FIGS. 3 to 10 to detect, from a sound signal which is a signal of a piece of music, the position of each beat in the sound signal. Then, the beat detection section 21 supplies beat information representative of the position of each of the beats in the sound signal to the beat feature quantity extraction section 23.

At step S12, the center removal section 22 removes a center component which is a component of sound positioned at the center between the left and the right from the sound signal in the form of a stereo signal and supplies a center-removed sound signal to the beat feature quantity extraction section 23.

Figure 13:
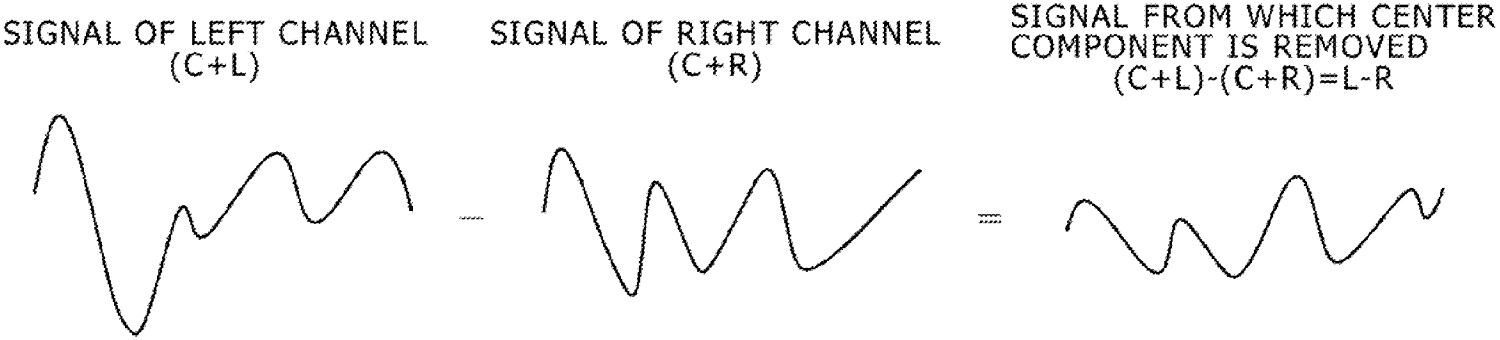
FIG. 13 is a view illustrating an example of removal of a center component from a sound signal.

For example, as seen in FIG. 13, the center removal section 22 determines the difference between a signal of one of the channels and a signal of the other channel from within the sound signal in the form of a stereo signal to remove the center component from the sound signal at step S12. More particularly, the center removal section 22 subtracts, from the signal of the left channel which includes a left component L which is a component of sound positioned on the left side and a center component C which is a component of sound positioned at the center between the left and the right from within the sound signal, the signal of the right channel which includes a right component R which is a component of the sound positioned on the right side and the center component C which is a component of the sound positioned at the center between the left and the right. The center removal section 22 thus produces a center-removed sound signal formed from a result of the subtraction of the right component R from the left component L with the center component C removed.

Further, for example, at step S12, the center removal section 22 divides the sound signal in the form of a stereo signal into a predetermined number of frequency bands. Then, if the difference between the phase of a signal of one of the channels and the phase of a signal of the other channel in any of the frequency bands is smaller than a threshold value determined in advance, then the center removal section 22 masks the sound signal in the frequency band to remove the center component from the sound signal.

Figure 14:
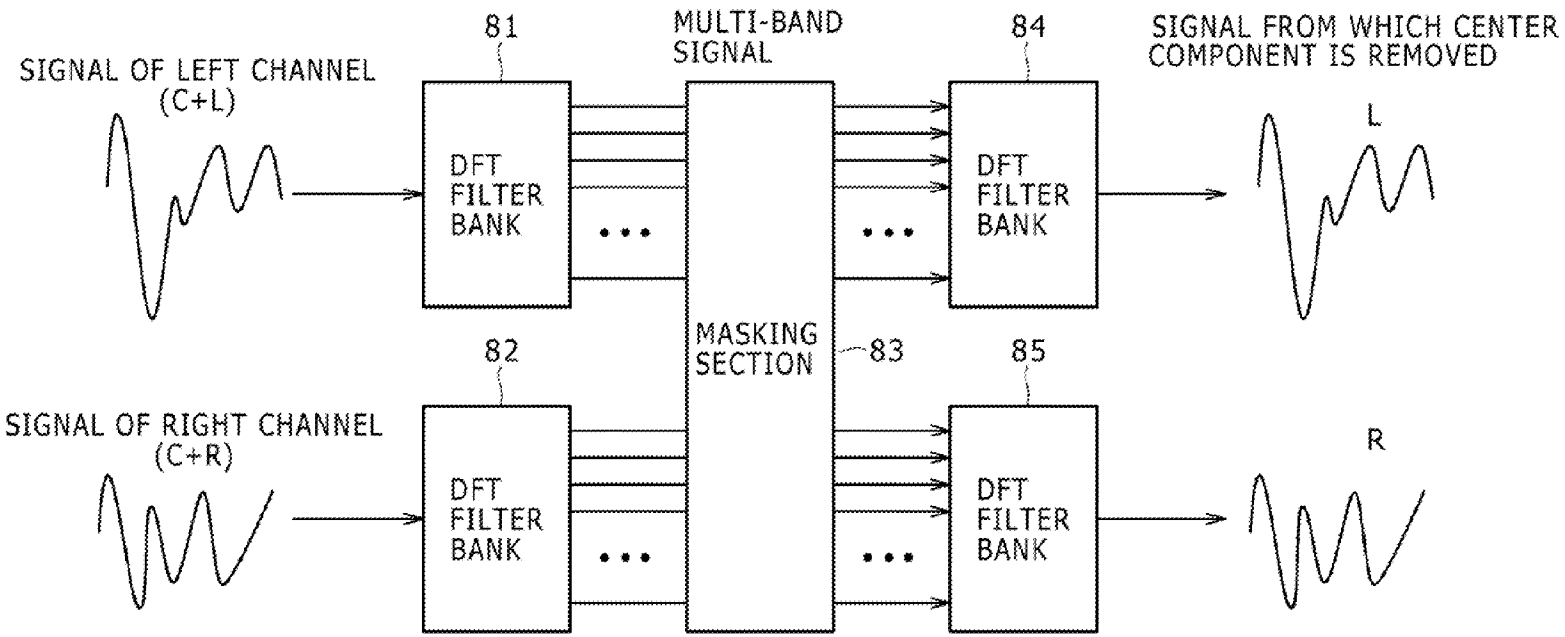
FIG. 14 is a block diagram showing an example of a configuration of a center removal section.

In this instance, as seen in FIG. 14, the center removal section 22 includes a DFT (Discrete Fourier Transform) filter bank 81, another DFT filter bank 82, a masking section 83, a further DFT filter bank 84 and a still further DFT filter bank 85.

The DFT filter bank 81 applies a process of discrete Fourier transform to the signal of the left channel which includes the left component L which is a component of sound positioned on the right side and the center component C which is a component of sound positioned at the center between the left and the right from within the sound signal to produce a multi-band signal indicative of a spectrum of a plurality of number of frequency bands in the multi-band signal produced by the DFT filter bank 81. The DFT filter bank 81 supplies the produced multi-band signal to the masking section 83.

The DFT filter bank 82 applies a process of discrete Fourier transform to the signal of the right channel which includes the right component R which is a component of sound positioned on the right side and the center component C which is a component of sound positioned at the center between the left and the right from within the sound signal to produce a multi-band signal indicative of a spectrum of a plurality of number of frequency bands. The DFT filter bank 82 supplies the produced multi-band signal to the masking section 83.

The masking section 83 compares the phase of the multi-band signal supplied from the DFT filter bank 81 and the phase of the multi-band signal supplied from the DFT filter bank 82 with each other for each frequency band. Then, if the difference between the phase of the multi-band signal supplied from the DFT filter bank 81 and the phase of the multi-band signal supplied from the DFT filter bank 82 is smaller than a threshold value determined in advance, then the masking section 83 masks the signal in the frequency band from within the multi-band signal supplied from the DFT filter bank 81 and the signal in the frequency band from within the multi-band signal supplied from the DFT filter bank 82.

The masking section 83 supplies the multi-band signal supplied from the DFT filter bank 81 and including the signal of the masked frequency band to the DFT filter bank 84. Further, the masking section 83 supplies the multi-band signal supplied from the DFT filter bank 82 and including the signal of the masked frequency band to the DFT filter bank 85.

The DFT filter bank 84 applies a process of inverse discrete Fourier transform to the multi-band signal supplied from the masking section 83 and including the signal of the masked frequency band to produce a signal from which the center component C which is a component of sound positioned at the center between the left and the right is removed and which includes only the left component L which is a component of sound positioned on the left side. The DFT filter bank 84 outputs the signal which includes only the left component L.

The DFT filter bank 85 applies a process of inverse discrete Fourier transform to the multi-band signal supplied from the masking section 83 and including the signal of the masked frequency band to produce a signal from which the center component C which is a component of sound positioned at the center between the left and the right is removed and which includes only the right component R which is a component of sound positioned on the right side. The DFT filter bank 85 outputs the signal which includes only the right component R.

Figure 15:
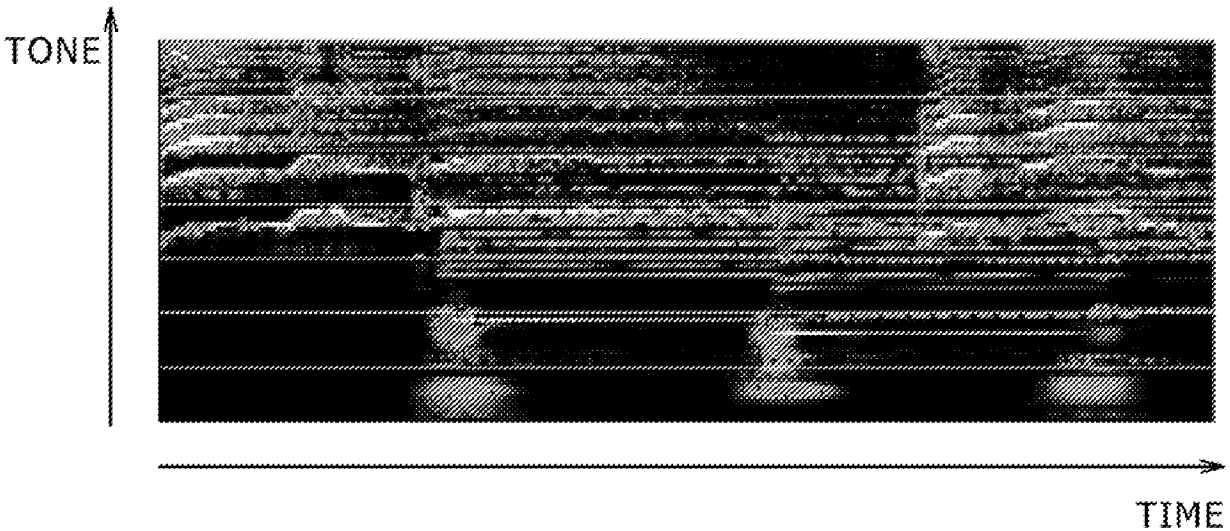
FIG. 15 is a view illustrating an example of an energy distribution of 12 sounds of different tones of a 12-tone equal temperament over a plurality of octaves of a sound signal.
Figure 16:
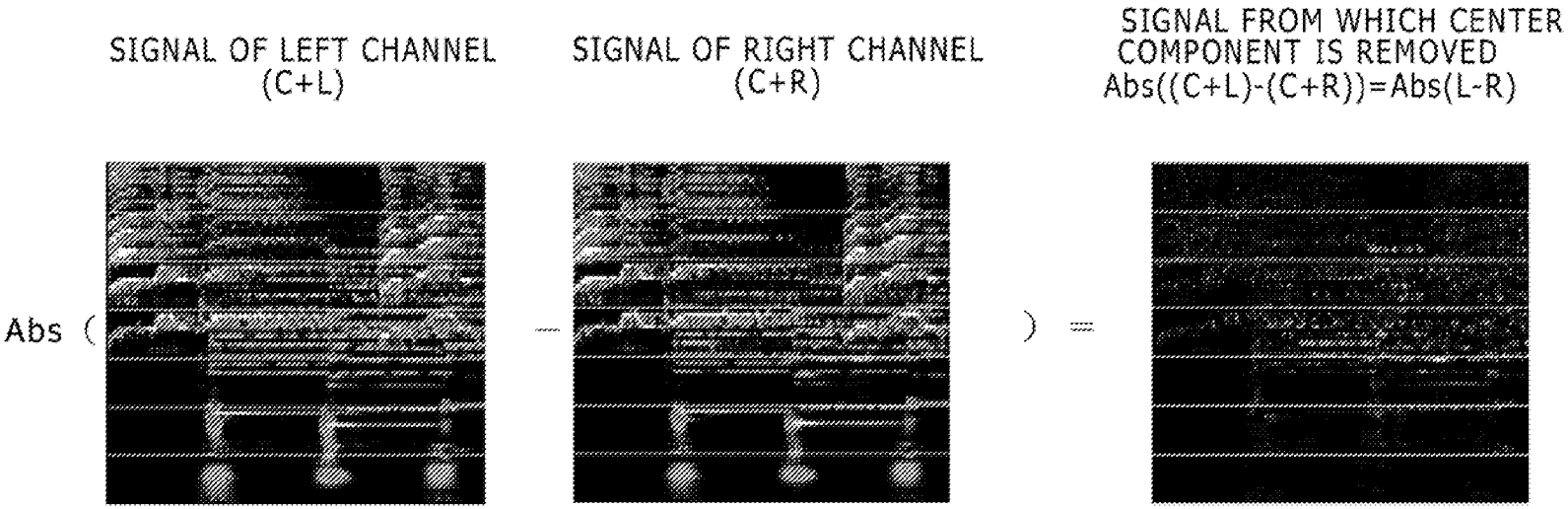
FIG. 16 is a view illustrating an example of removal of a center component from a sound signal.

Further, for example, as seen in FIG. 15, a center-removed sound signal may be determined from the energy levels of the 12 sounds of the different tones of the 12-tone equal temperament in a plurality of octaves of the sound signal.

In particular, the following measures may be taken. In particular, at step S12, the center removal section 22 divides each of the signals of the left and right channels of the sound signal into components of a plurality of octaves and determines the energy levels of the 12 sounds of different tones of the 12-tone equal temperament in the individual octaves. Then, the center removal section 22 performs, for each sound in the individual octaves, subtraction of the energy level determined from the signal of the right channel from the energy level determined from the signal of the left channel. Then, the center removal section 22 determines a signal composed of the absolute value of a result of the subtraction and determines the determined signal as a center-removed sound signal.

It is to be noted that, in this instance, since the base signal is important in extraction of a chord, such a countermeasure that the difference between the signal of the left channel and the signal of the right channel is not calculated with regard to the frequency band which includes the base signal.

The sound signal frequently includes a vocal line or a component of sound of an instrument of percussion which exhibits high energy as a center component.

Therefore, in order to make it possible to decide a chord with a higher degree of accuracy, the center component is removed from the sound signal in the form of a stereo signal.

The following example is given taking a center-removed sound signal which indicates an absolute value of the difference in energy of the 12 sounds of different tones of the 12-tone equal temperament in the individual octaves between the signal of the left channel and the signal of the right channel as an example.

Referring back to FIG. 12, the beat feature quantity extraction section 23 extracts the chord decision feature quantity for each beat from the original sound signal at step S13. In particular, at step S13, the beat feature quantity extraction section 23 extracts, from the sound signal from which the center component is not removed, the feature quantity representative of characteristics of each of the sounds of different tones of the 12-tone equal temperament within the range of each beat.

At step S14, the beat feature quantity extraction section 23 extracts the chord decision feature quantity for each beat from the center-removed sound signal from which the center component is removed. In particular, at step S14, the beat feature quantity extraction section 23 extracts the feature quantity representative of characteristics of the sounds of different tones of the 12-tone equal temperament within the range of each beat from the sound signal from which the center component is removed.

At steps S13 and S14, the beat feature quantity extraction section 23 extracts the feature quantity of the sound signal from which the center component is removed and the sound signal from which the center component is not removed within the range of each beat based on the beat information representative of the positions of the beats detected by the beat detection section 21.

Figure 17:
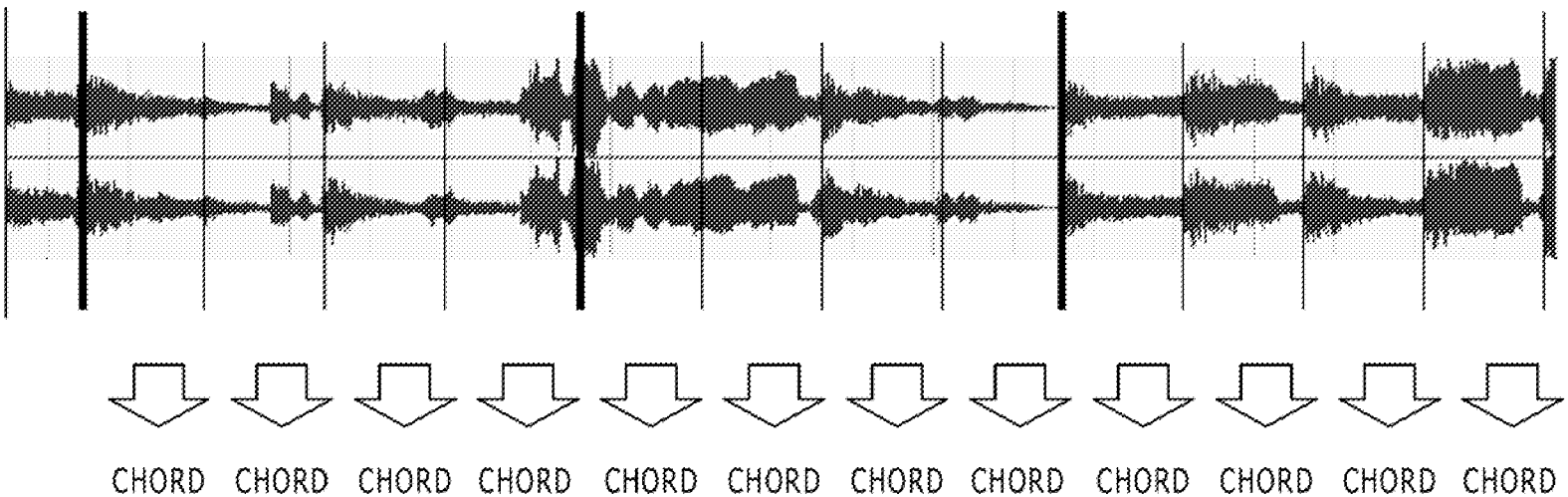
FIG. 17 is a view illustrating decision of a chord within each of beats.

As seen in FIG. 17, a chord is decided from the characteristics within the range of each beat in a chord decision process for each beat at step S15 hereinafter described. At steps S13 and S14, the feature quantity within the range of each beat of the sound signal to be used for the decision of a chord within the range of each beat of the sound signal are extracted.

Here, details of extraction of a feature quantity from the range of a beat of the sound signal which may be the sound signal from which the center component is removed or the sound signal from which the center component is not removed are described.

First, the beat feature quantity extraction section 23 divides the signal of the right channel and the signal of the left channel of the sound signal from which the center component is not removed into components of a plurality of octaves. Then, the beat feature quantity extraction section 23 determines the energy level of each of the 12 sounds of different tones of the 12-tone equal temperament in each of the octaves. For example, the beat feature quantity extraction section 23 sums the energy level determined from the signal of the left channel and the energy level determined from the right channel for each of the sounds of the octaves.

By the processes, the sound signal from which the center component is not removed is converted into energy levels of the 12 sounds of different tones of the 12-tone equal temperament in the octaves similarly to the center-removed sound signal in the form which indicates absolute values of differences of the energy levels of the 12 sounds of different tones of the 12-tone equal temperament in the octaves between the signal of the left channel and the signal of the right channel.

Figure 18:
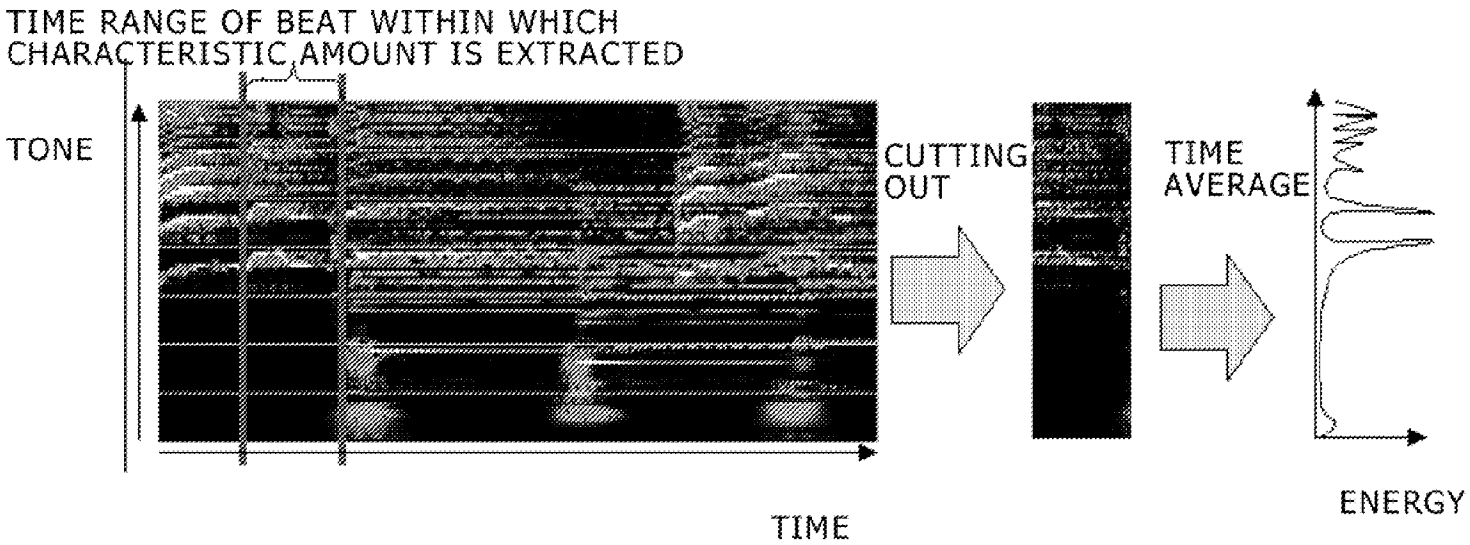
FIG. 18 is a view illustrating extraction of a feature quantity from a range of a beat of a sound signal.

Then, as seen in FIG. 18, the beat feature quantity extraction section 23 cuts out, from one of the sound signal from which the center component is removed and the sound signal from which the center component is not removed, both in the form of energy levels of the 12 sounds of different tones of the 12-tone equal temperament in the octaves, only a signal within the range of a beat from the position of a predetermined beat to the position of a next beat based on the positions of the beats indicated by the beat information.

The beat feature quantity extraction section 23 averages the energy level indicated by the signal within the cut out range of the beat with respect to time. Consequently, as seen at a right portion in FIG. 18, the energy levels of the 12 sounds of different tones of the 12-tone equal temperament in the octaves are determined.

Figure 19:
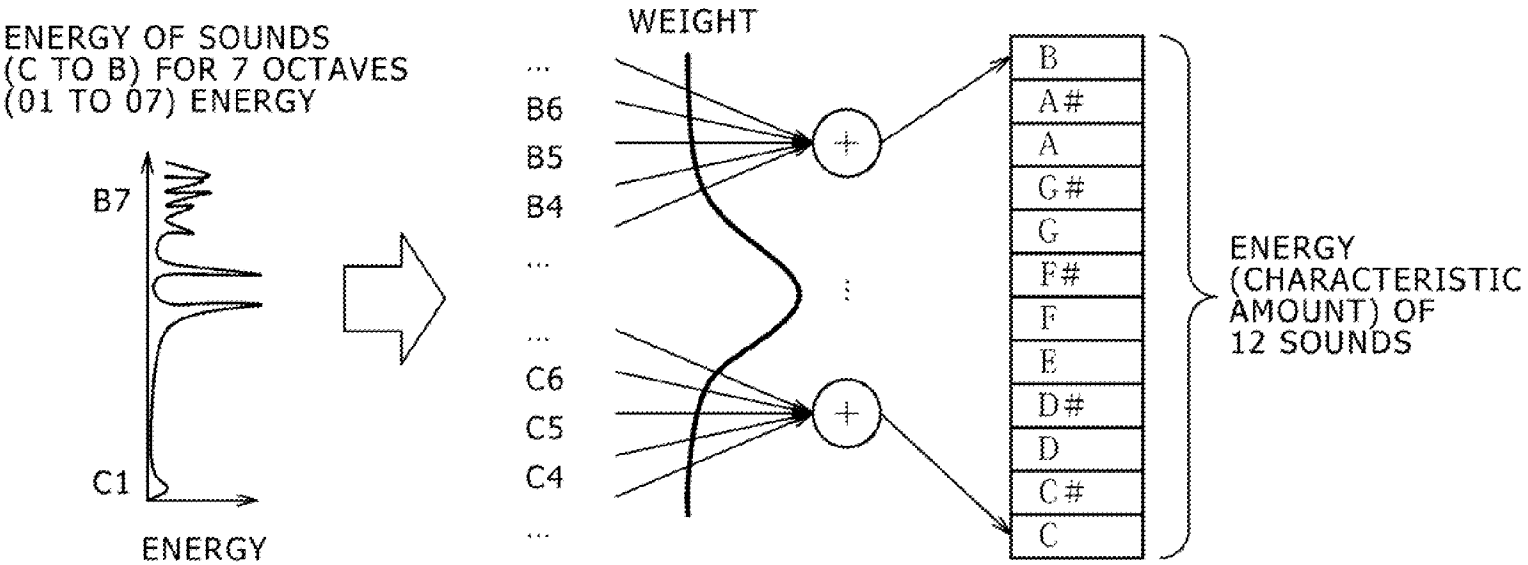
FIG. 19 is a view illustrating production of a feature quantity indicative of an energy level of each of sounds in an order of the musical scale.

Further, as seen in FIG. 19, the beat feature quantity extraction section 23 weights the energy levels of the 12 sounds of different tones of the 12-tone equal temperament, for example, of 7 octaves. In this instance, the beat feature quantity extraction section 23 weights the energy levels of the sounds with weights determined in advance for the individual 12 sounds of different tones of the 12-tone equal temperament in the octaves.

Then, for example, the beat feature quantity extraction section 23 sums the energy levels of the sounds of the same sound names in the 7 individual octaves to determine energy levels of the 12 sounds specified by the individual sound names. The beat feature quantity extraction section 23 arranges the energy levels of the 12 sounds in the order of the music scale of the sound names to produce feature quantity indicative of the energy levels of the sounds in the order of the music scale.

In particular, for example, the beat feature quantity extraction section 23 sums the energy levels of the sounds C1, C2, C3, C4, C5, C6 and C7 from among the weighted energy levels to determine the energy level of the sounds having the sound name of C. Further, the beat feature quantity extraction section 23 sums the energy levels of the sounds C#1, C#2, C#3, C#4, C#5, C#6 and C#7 from among the weighted energy levels to determine the energy level of the sounds having the sound name of C#.

Similarly, the beat feature quantity extraction section 23 sums the energy levels of the sounds D, D#, E, F, F#, G, G#, A, A# and B of the octaves O1 to O7 to determine the energy levels of the sounds having the sound names of D, D#, E, F, F#, G, G#, A, A# and B, respectively.

The beat feature quantity extraction section 23 produces feature quantity which are data indicative of the energy levels of the sounds having the sound names of C, C#, D, D#, E, F, F#, G, G#, A, A# and B and arranged in the order of the musical scale.

In this manner, the beat feature quantity extraction section 23 produces feature quantity from within the range of a beat of a sound signal which is one of the sound signal from which the center component is removed and the signal from which the center component is not removed.

It is to be noted that the beat feature quantity extraction section 23 produces, as a chord decision feature quantity for each beat from within a range of a beat of the sound signal from which the center component is not removed, a feature quantity (hereinafter referred to as original signal root decision feature quantity) to be used for the decision of a root and another feature quantity (hereinafter referred to as original signal major/minor decision feature quantity) to be used for the decision of whether a chord is a major chord or a minor chord.

The weight for weighting the energy level of sound which is used in production of an original signal root decision feature quantity and the weight for weighting the energy level of sound which is used in production of an original signal major/minor decision feature quantity are different from each other.

The beat feature quantity extraction section 23 produces, as a chord decision feature quantity for each beat from within a range of a beat of the sound signal from which the center component is removed, a feature quantity (hereinafter referred to as center-removed root decision feature quantity) to be used for the decision of a root and another feature quantity (hereinafter referred to as center-removed major/minor decision feature quantity) to be used for the decision of whether a chord is a major chord or a minor chord.

The weight for weighting the energy level of sound which is used in production of a center-removed root decision feature quantity and the weight for weighting the energy level of sound which is used in production of a center-removed major/minor decision feature quantity are different from each other.

Figure 20:
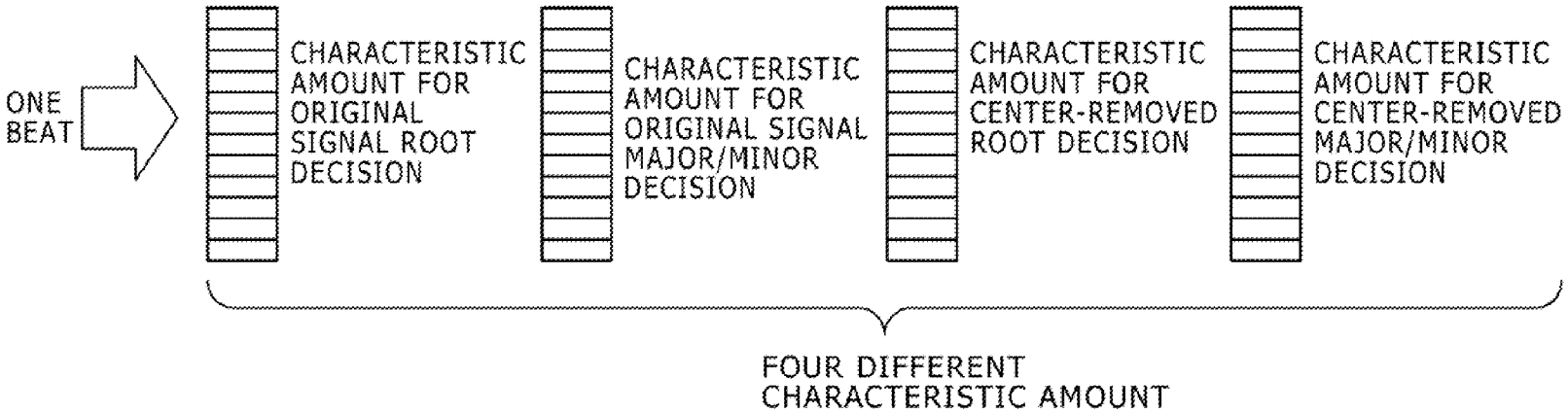
FIG. 20 is a view illustrating chord decision feature quantity for each beat.

In this manner, as seen in FIG. 20, the beat feature quantity extraction section 23 produces, as the chord decision feature quantity for each beat, an original signal root decision feature quantity, an original signal major/minor decision feature quantity, a center-removed root decision feature quantity and a center-removed major/minor decision feature quantity.

Referring back to FIG. 12, the chord decision section 24 executes a chord decision process for each beat at step S15, and then the chord decision process is ended.

Figure 21:
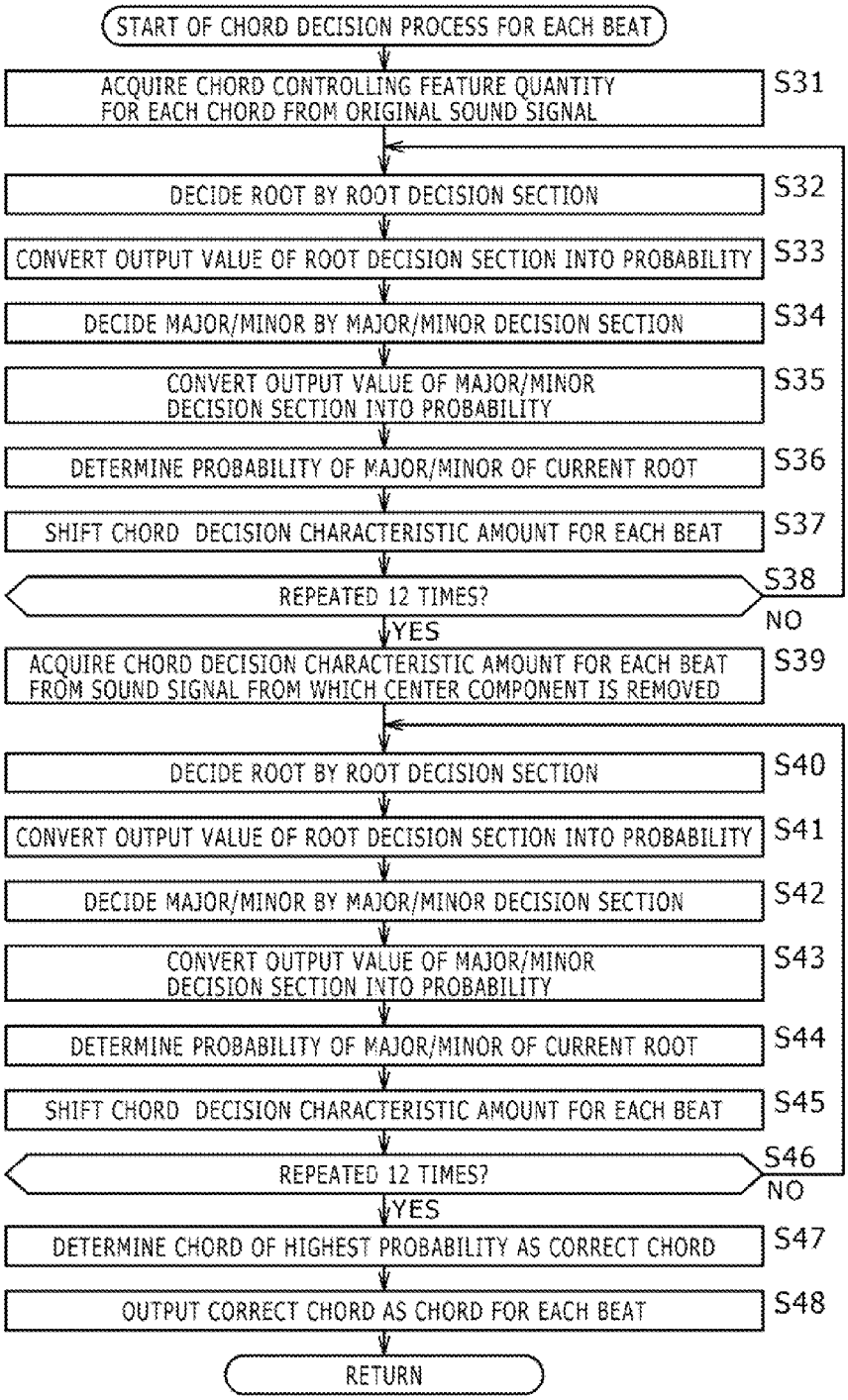
FIG. 21 is a flow chart illustrating an example of a chord decision process for each beat.

FIG. 21 illustrates details of an example of the chord decision process for each beat.

Referring to FIG. 21, the chord decision section 24 acquires chord decision feature quantity for each beat from the original sound signal at step S31. In particular, the chord decision section 24 acquires the original signal root decision feature quantity and the original signal major/minor decision feature quantity of the chord decision feature quantity for each beat supplied from the beat feature quantity extraction section 23.

At step S32, the root decision section 64 performs root decision based on the original signal root decision feature quantity. For example, at step S32, the root decision section 64 decides from the original signal root decision feature quantity indicative of the energy levels of the individual sounds of the tones in the order of the musical scale with reference to a reference sound which is a sound of a predetermined tone whether or not the reference sound is a root. In this instance, the root decision section 64 outputs a discrimination function for deciding whether or not the reference sound is a root.

In particular, for example, at step S32, the root decision section 64 decides, from the original signal root decision feature quantity, whether the reference sound which is the sound of the first data of the original signal root decision feature quantity is a root, and outputs the discrimination function.

At step S33, the probability calculation section 66 converts the output value from the root decision section 64 into a probability. In particular, at step S33, the probability calculation section 66 converts the discrimination function for the decision of whether or not the reference sound from the root decision section 64 is a root into a probability.

At step S34, the major/minor decision section 65 decides based on the original signal major/minor decision feature quantity whether or not the chord is a major chord or a minor chord. For example, at step S34, the major/minor decision section 65 decides from the original signal major/minor decision feature quantity indicative of the energy levels of the sounds of the tones in the order of the musical scale with reference to the reference sound which is a sound of a predetermined tone whether the chord is a major chord or a minor chord. In this instance, the major/minor decision section 65 outputs a discrimination function for the discrimination of whether the chord is a major chord or minor chord.

At step S35, the probability calculation section 66 converts the output value from the major/minor decision section 65 into a probability. In particular, at step S35, the probability calculation section 66 converts the discrimination function for the decision of whether the chord is a major chord or a minor chord from the major/minor decision section 65 into a probability.

At step S36, the chord decision section 24 determines the probabilities that the current root is that of a major chord and that of a minor chord from the probability determined at step S33 and the probability determined at step S35.

At step S37, the shift register 61 shifts the chord decision feature quantity for each beat.

At step S38, the chord decision section 24 decides whether or not the processes at steps S32 to S38 are repeated 12 times. If it is decided that the processes are not repeated 12 times, then the processing returns to step S32 so that the processes at steps S32 to S38 are repeated using the shifted chord decision feature quantity for each beat.

Figure 22:
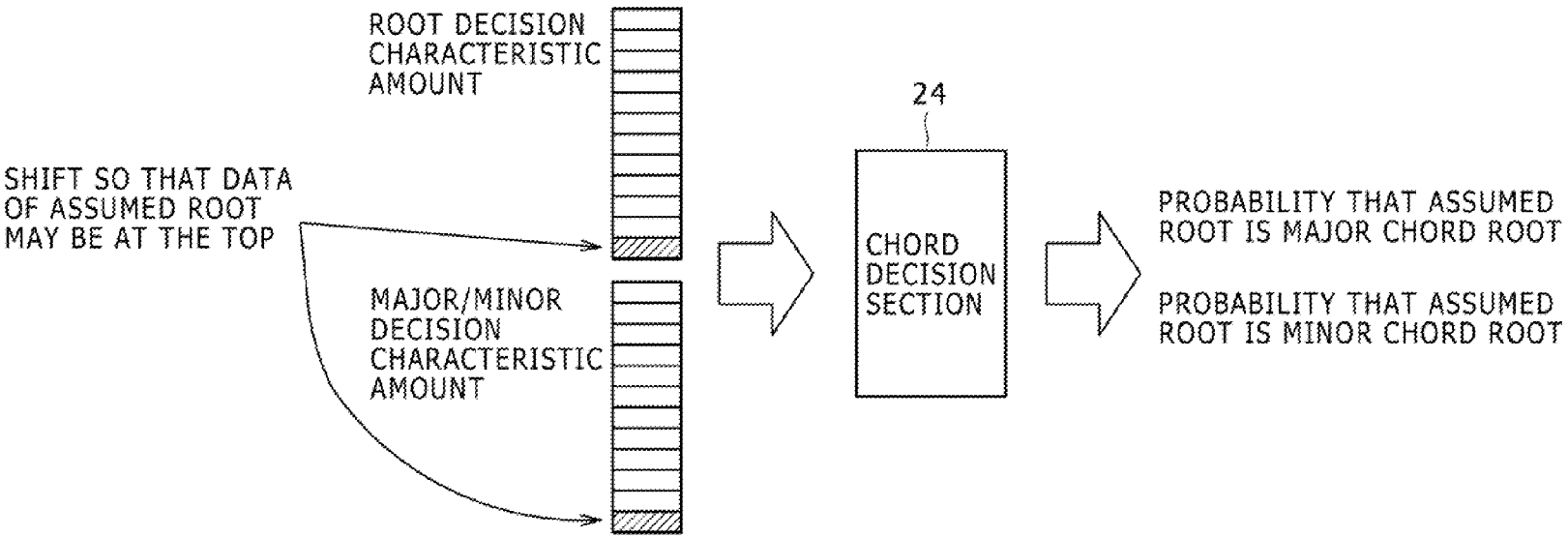
FIGS. 22 and 23 are views illustrating different processes of the chord decision section.

As shown in FIG. 22, the chord decision section 24 successively assumes the root as C to B to shift the chord decision feature quantity so that the data of the assumed root comes to the top and then successively determines the probability that the assumed root is that of a major chord and the probability that the assumed root is that of a minor chord.

For example, the chord decision section 24 uses the original signal root decision feature quantity and the original signal major/minor decision feature quantity in the form of data representative of the energy levels of the sounds of the 12 different sound names and arranged in the order of the musical scale to determine the probability that the chord is a major chord wherein the sound of the energy level arranged at a position determined in advance which is, for example, the position indicated by slanting lines in FIG. 22 is a root and the probability that the chord is a minor chord wherein the sound of the energy level arranged at the position is a root.

For example, where the data representative of the energy levels of the sounds of the sound names of C, C#, D, D#, E, F, F#, G, G#, A, A# and B are arranged in this order in the original signal root decision feature quantity and the original signal major/minor decision feature quantity, the chord decision section 24 determines the probability that the sound C of the energy level arranged at the top of the chord decision feature quantity and indicated by slanting lines in FIG. 22 is of a major chord and the probability that the sound C is of a minor chord.

The shift register 61 cyclically shifts, that is, rotationally shifts, the arrangement of data indicative of the energy levels of the sounds of the 12 different sound names in the order of the musical scale in the original signal root decision feature quantity and the original signal major/minor decision feature quantity. For example, where the sound of the energy level arranged at the top indicated by slanting lines in FIG. 22 is C and the data indicative of the energy levels of the sounds of the sound names of C, C#, D, D#, E, F, F#, G, G#, A, A# and B are arranged in this order in the original signal root decision feature quantity and the original signal major/minor decision feature quantity, the shift register 61 shifts the arrangement of the data indicative of the energy levels in the original signal root decision feature quantity and the original signal major/minor decision feature quantity so that the data indicative of the energy levels of the sounds of the sound names of C#, D, D#, E, F, F#, G, G#, A, A#, B and C are arranged in this order. In this instance, the sound of the energy level disposed at the top of the chord decision feature quantity indicated by slanting lines in FIG. 22 is C#.

The chord decision section 24 determines, from the original signal root decision feature quantity and the original signal major/minor decision feature quantity shifted so that the data indicative of the energy levels of the sounds of the sound names of C#, D, D#, E, F, F#, G, G#, A, A#, B and C are arranged in this order, the probability that the chord is a major chord of C# and the probability that the chord is a minor chord of C#.

By repeating the process of shifting the arrangement of data indicative of the energy levels of sound in the original signal root decision feature quantity and the original signal major/minor decision feature quantity to determine the probability that the chord is a major chord whose root is the reference sound which is a sound of the energy level arranged at a position determined in advance such as, for example, the top of the chord decision feature quantity and the probability that the chord is a minor chord whose root is the reference sound, the chord decision section 24 determines the probability that the chord is a major chord of D and the probability that the chord is a minor chord of D to the probability that the chord is a major chord of B and the probability that the chord is a minor chord of B.

Figure 23:
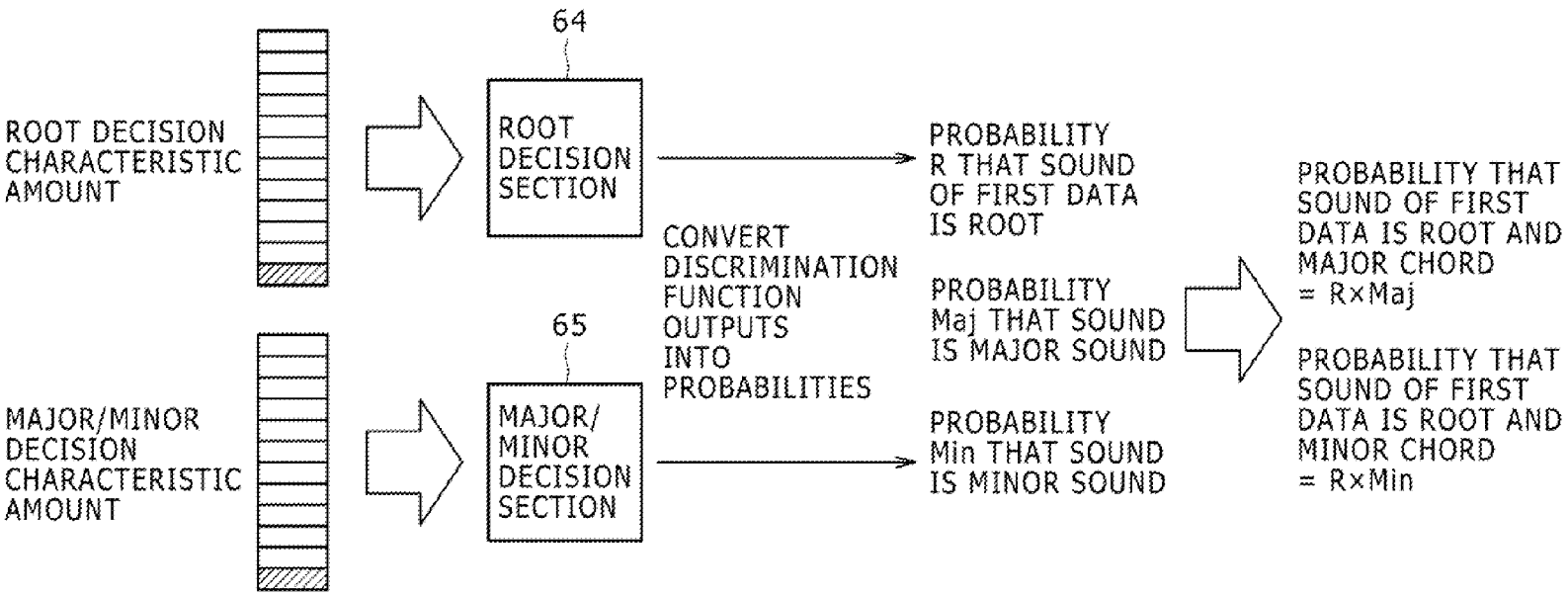

The process described above is described in more detail. In particular, at step S32 shown in FIG. 23, the root decision section 64 decides, from the original signal root decision feature quantity indicative of the energy levels of the sounds of the tones in the order of the musical scale with reference to a reference sound which is a sound of a predetermined tone, whether or not the reference sound is a root. Then, the root decision section 64 outputs a discrimination function for the decision of whether or not the reference sound is a root.

At step S33, the probability calculation section 66 converts the discrimination function for the decision of whether or not the reference sound is a root from the root decision section 64 into a probability to determine a probability R that the reference sound is a root.

Then at step S34, the major/minor decision section 65 decides, from the original signal major/minor decision feature quantity indicative of the energy levels of the sounds of the tones in the order of the musical scale with reference to the reference sound which is a sound of the predetermined tone, whether the chord is a major chord or a minor chord. Then, the major/minor decision section 65 outputs a discrimination function for the decision of whether the chord is a major chord or a minor chord.

At step S35, the probability calculation section 66 converts the discrimination function for the decision of whether the chord is a major chord or a minor chord from the major/minor decision section 65 into a probability to decide a probability Maj that the chord is a major chord and a probability Min that the chord is a minor chord.

The chord decision section 24 multiplies the right component R and the probability Maj to calculate the probability that the chord is a major chord whose root is the reference sound. Further, the chord decision section 24 multiplies the right component R and the probability Min to calculate the probability that the chord is a minor chord whose root is the reference sound.

Figure 24:
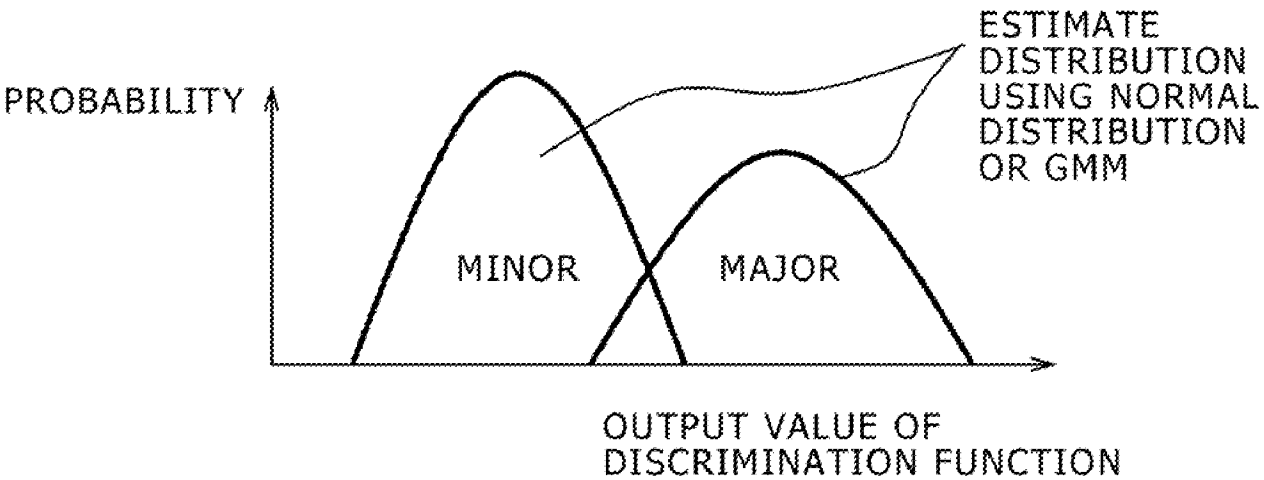
FIG. 24 is a view illustrating an example of an output of a discrimination function.

It is to be noted that, as seen from FIG. 24 which illustrates an example of output values of the discrimination function for the decision of whether the chord is a major chord or a minor chord, since the output values of the discrimination function are continuous values different from a probability, where an output value of the discrimination function is converted into a probability, the probability calculation section 66 uses a normal discrimination or a GMM (Gaussian Mixture Model) to estimate the probabilities of individual states corresponding to the output values of the discrimination function.

Figure 25:
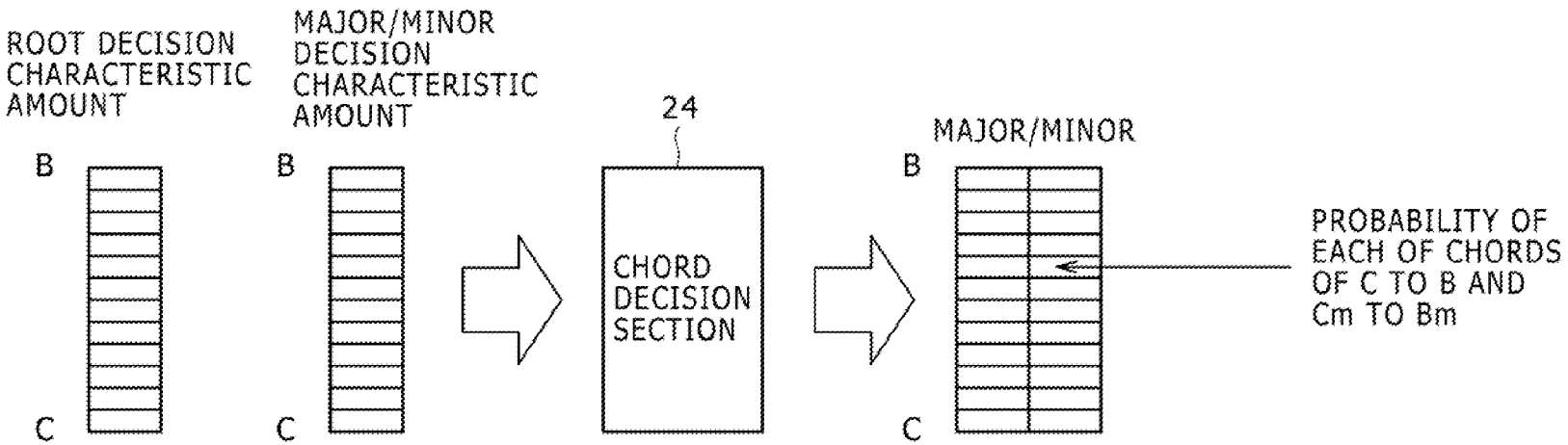
FIGS. 25 and 26 are views illustrating different processes of the chord decision section.

Thus, as seen in FIG. 25, the chord decision section 24 determines, from the original signal root decision feature quantity and the original signal major/minor decision feature quantity, the probability that the chord within the range of a beat is a major chord of C and the probability that the chord is a minor chord of C to the probability that the chord is a major chord of B and the probability that the chord is a minor chord of B. In particular, the chord decision section 24 determines, from the original signal root decision feature quantity and the original signal major/minor decision feature quantity, the probability that the chord is a major chord of C, the probability that the chord is a minor chord of C, the probability that the chord is a major chord of C#, the probability that the chord is a minor chord of C#, the probability that the chord is a major chord of D, the probability that the chord is a minor chord of D, the probability that the chord is a major chord of D#, the probability that the chord is a minor chord of D#, the probability that the chord is a major chord of E, the probability that the chord is a minor chord of E, the probability that the chord is a major chord of F, the probability that the chord is a minor chord of F, the probability that the chord is a major chord of F#, the probability that the chord is a minor chord of F#, the probability that the chord is a major chord of G, the probability that the chord is a minor chord of G, the probability that the chord is a major chord of G#, the probability that the chord is a minor chord of G#, the probability that the chord is a major chord of A, the probability that the chord is a minor chord of A, the probability that the chord is a major chord of A#, the probability that the chord is a minor chord of A#, the probability that the chord is a major chord of B, and the probability that the chord is a minor chord of B.

Referring back to FIG. 21, if it is decided at step S38 that the processes at steps S32 to S38 are repeated 12 times, then the processing advances to step S39.

At step S39, the chord decision section 24 acquires chord decision feature quantity for each beat from the sound signal from which the center component is removed. In particular, the chord decision section 24 acquires the center-removed root decision feature quantity and the center-removed major/minor decision feature quantity of the chord decision feature quantity for each beat supplied from the beat feature quantity extraction section 23.

At step S40, the root decision section 62 performs root decision based on the center-removed root decision feature quantity. For example, at step S40, the root decision section 62 decides from the center-removed root decision feature quantity indicative of the energy levels of the individual sounds of the tones in the order of the musical scale with reference to a reference sound which is a sound of a predetermined tone whether or not the reference sound is a root. In this instance, the root decision section 62 outputs a discrimination function for deciding whether or not the reference sound is a root.

At step S41, the probability calculation section 66 converts the output value from the root decision section 62 into a probability. In particular, at step S41, the probability calculation section 66 converts the discrimination function for the decision of whether or not the reference sound is a root from the root decision section 62 into a probability.

At step S42, the major/minor decision section 63 decides based on the center-removed major/minor decision feature quantity whether the chord is a major chord or a minor chord. For example, at step S42, the major/minor decision section 63 decides from the center-removed root decision feature quantity indicative of the energy levels of the sounds of the tones in the order of the musical scale with reference to the reference sound which is a sound of a predetermined tone whether the chord is a major chord or a minor chord. In this instance, the major/minor decision section 63 outputs a discrimination function for the discrimination of whether the chord is a major chord or a minor chord.

At step S43, the probability calculation section 66 converts the output value from the major/minor decision section 63 into a probability. In particular, at step S43, the probability calculation section 66 converts the discrimination function for the decision of whether the chord is a major chord or a minor chord from the major/minor decision section 63 into a probability.

At step S44, the chord decision section 24 determines the probabilities that the current root is that of a major chord and that of a minor chord from the probability determined at step S41 and the probability determined at step S43.

At step S45, the shift register 61 shifts the chord decision feature quantity for each beat.

At step S46, the chord decision section 24 decides whether or not the processes at steps S40 to S45 are repeated 12 times. If it is decided that the processes are not repeated 12 times, then the processing returns to step S40 so that the processes at steps S40 to S45 are repeated using the shifted chord decision feature quantity for each beat.

Figure 26:
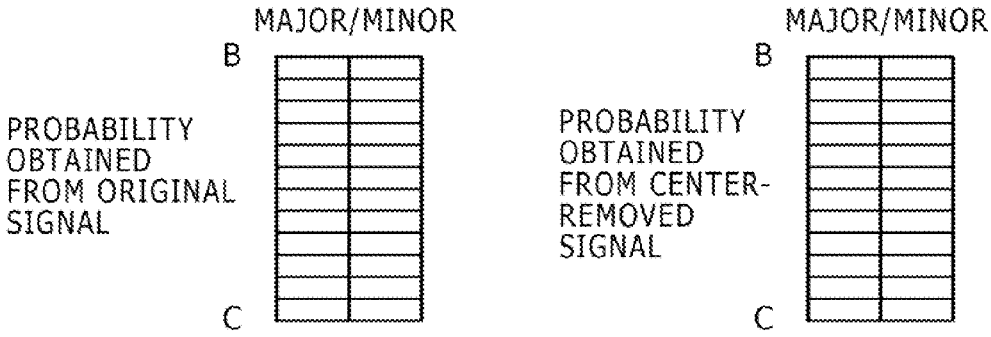

As seen in FIG. 26, separately from the probability that a chord within a range of a beat is a major chord of C and the probability that the chord is a minor chord of C to the probability that the chord is a major chord of B and the probability that the chord is a minor chord of B, which are determined from the original signal root decision feature quantity and the original signal major/minor decision feature quantity, the probability that a chord within a range of a beat is a major chord of C and the probability that the chord is a minor chord of C to the probability that the chord is a major chord of B and the probability that the chord is a minor chord of B are determined from the center-removed root decision feature quantity and the center-removed major/minor decision feature quantity by the processes at steps S31 to S46.

In this manner, chords within the ranges of individual beats are determined through synthetic decision from the probabilities of chords determined from various characteristics.

Referring back to FIG. 21, if it is decided at step S46 that the processes at steps S40 to S45 are repeated 12 times, then the processing advances to step S47.

At step S47, the chord decision section 24 determines a chord of the highest probability as a correct chord. In particular, the chord decision section 24 determines the chord of the highest probability from among the probability that a chord within a range of a beat is a major chord of C and the probability that the chord is a minor chord of C to the probability that the chord is a major chord of B and the probability that the chord is a minor chord of B, which are determined from the original signal root decision feature quantity and the original signal major/minor decision feature quantity as well as the probability that a chord within a range of a beat is a major chord of C and the probability that the chord is a minor chord of C to the probability that the chord is a major chord of B and the probability that the chord is a minor chord of B are determined from the center-removed root decision feature quantity and the center-removed major/minor decision feature quantity as the correct chord.

Further, the chord decision section 24 determines a chord of the highest average probability as a correct chord. In particular, the chord decision section 24 determines the chord of the highest one of average probabilities between the probability that a chord within a range of a beat is a major chord of C and the probability that the chord is a minor chord of C to the probability that the chord is a major chord of B and the probability that the chord is a minor chord of B, which are determined from the original signal root decision feature quantity and the original signal major/minor decision feature quantity, and the probability that a chord within a range of a beat is a major chord of C and the probability that the chord is a minor chord of C to the probability that the chord is a major chord of B and the probability that the chord is a minor chord of B, which are determined from the center-removed root decision feature quantity and the center-removed major/minor decision feature quantity, as the correct chord. For example, the chord decision section 24 determines, for each of the probability that a chord is a major chord of C and the probability that the chord is a minor chord of C to the probability that the chord is a major chord of B and the probability that the chord is a minor chord of B, average values of the probabilities determined from the original signal root decision feature quantity and the original signal major/minor decision feature quantity and the probabilities determined from the center-removed root decision feature quantity and the center-removed major/minor decision feature quantity. Then, the chord decision section 24 determines the chord of the highest one of average probabilities which are the thus determined average values as a correct chord.

At step S48, the chord decision section 24 outputs the correct chord as a chord for each beat. Thereafter, the processing is ended. It is to be noted that, in this instance, the chord decision section 24 outputs, as a chord for each beat, the chord name of the chord.

In this manner, a chord of a piece of music can be decided accurately from a sound signal.

The chord decision section 24 may be configured otherwise such that it decides a root and then decides whether or not a chord is a major chord or a minor chord from feature quantity indicative of the energy levels of the sounds of the tones in the order of the musical scale without determining probabilities.

Figure 27:
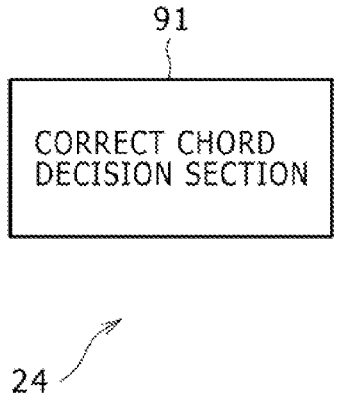
FIG. 27 is a block diagram showing another example of the configuration of the chord decision section.

FIG. 27 shows another example of the configuration of the chord decision section 24 where it decides a root and then decides whether or not a chord is a major chord or a minor chord from feature quantity indicative of the energy levels of the sounds of the tones in the order of the musical scale without determining probabilities.

The chord decision section 24 includes a correct chord decision section 91.

The correct chord decision section 91 decides a root and decides whether the chord is a major chord or a minor chord from the original signal root decision feature quantity and the original signal major/minor decision feature quantity as well as the center-removed root decision feature quantity and the center-removed major/minor decision feature quantity. For example, the correct chord decision section 91 directly outputs an index indicative of a correct chord from the original signal root decision feature quantity and the original signal major/minor decision feature quantity as well as the center-removed root decision feature quantity and the center-removed major/minor decision feature quantity.

In particular, the correct chord decision section 91 decides, from the original signal root decision feature quantity and the original signal major/minor decision feature quantity as well as the center-removed root decision feature quantity and the center-removed major/minor decision feature quantity, whether or not the reference sound is a root and decides the type of the chord, that is, at least whether the chord is a major chord or a minor chord.

Figure 28:
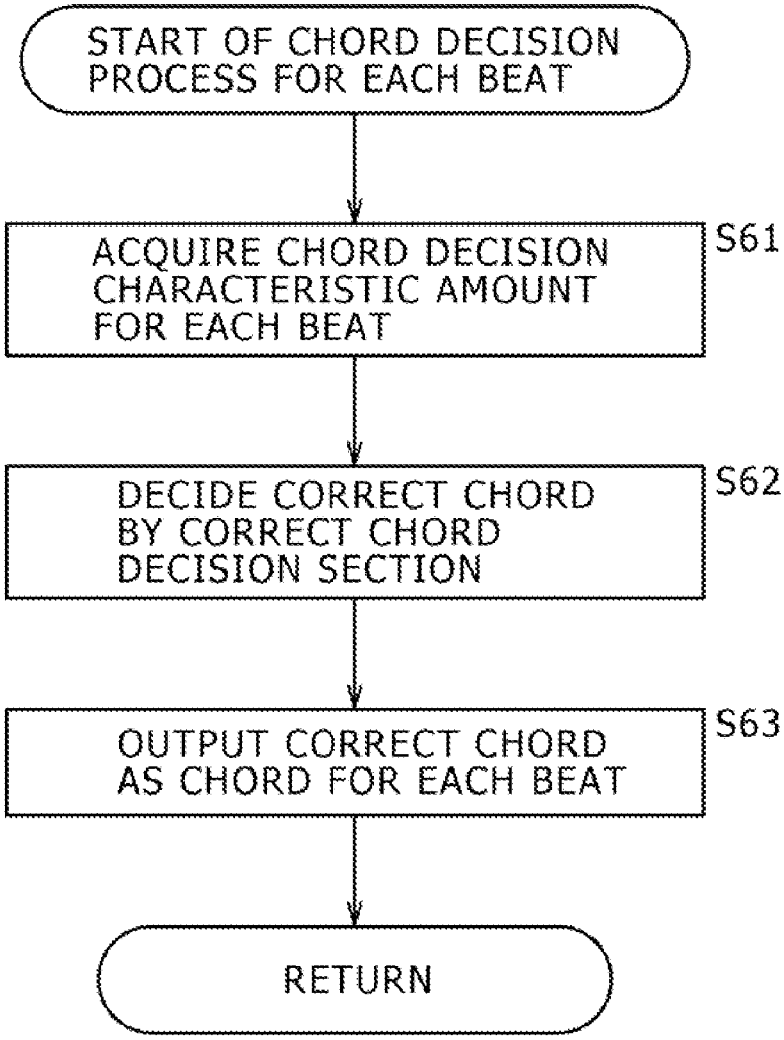
FIG. 28 is a flow chart illustrating details of another example of the chord decision process for each beat.

FIG. 28 illustrates details of an other example of the chord decision process for each beat by the chord decision section 24 which is formed from the correct chord decision section 91.

At step S61, the chord decision section 24 acquires the chord decision feature quantity including for each beat the original signal root decision feature quantity and the original signal major/minor decision feature quantity as well as the center-removed root decision feature quantity and the center-removed major/minor decision feature quantity from the beat feature quantity extraction section 23.

At step S62, the correct chord decision section 91 of the chord decision section 24 decides a correct chord. For example, at step S62, the correct chord decision section 91 decides a correct chord indicative of a chord whose range of the beat is correct from among the major chord of C, minor chord of C, major chord of C#, minor chord of C#, major chord of D, minor chord of D, major chord of D#, minor chord of D#, major chord of E, minor chord of E, major chord of F, minor chord of F, major chord of F#, minor chord of F#, major chord of G, minor chord of G, major chord of G#, minor chord of G#, major chord of A, minor chord of A, major chord of A#, minor chord of A#, major chord of B and minor chord of B.

At step S63, the chord decision section 24 outputs the correct chord as a cord for each beat, and the processing is ended. Also in this instance, the chord decision section 24 can output the chord name of the chord as the chord for each beat.

Now, learning based on a feature quantity for producing the chord decision section 24 is described.

Figure 29:
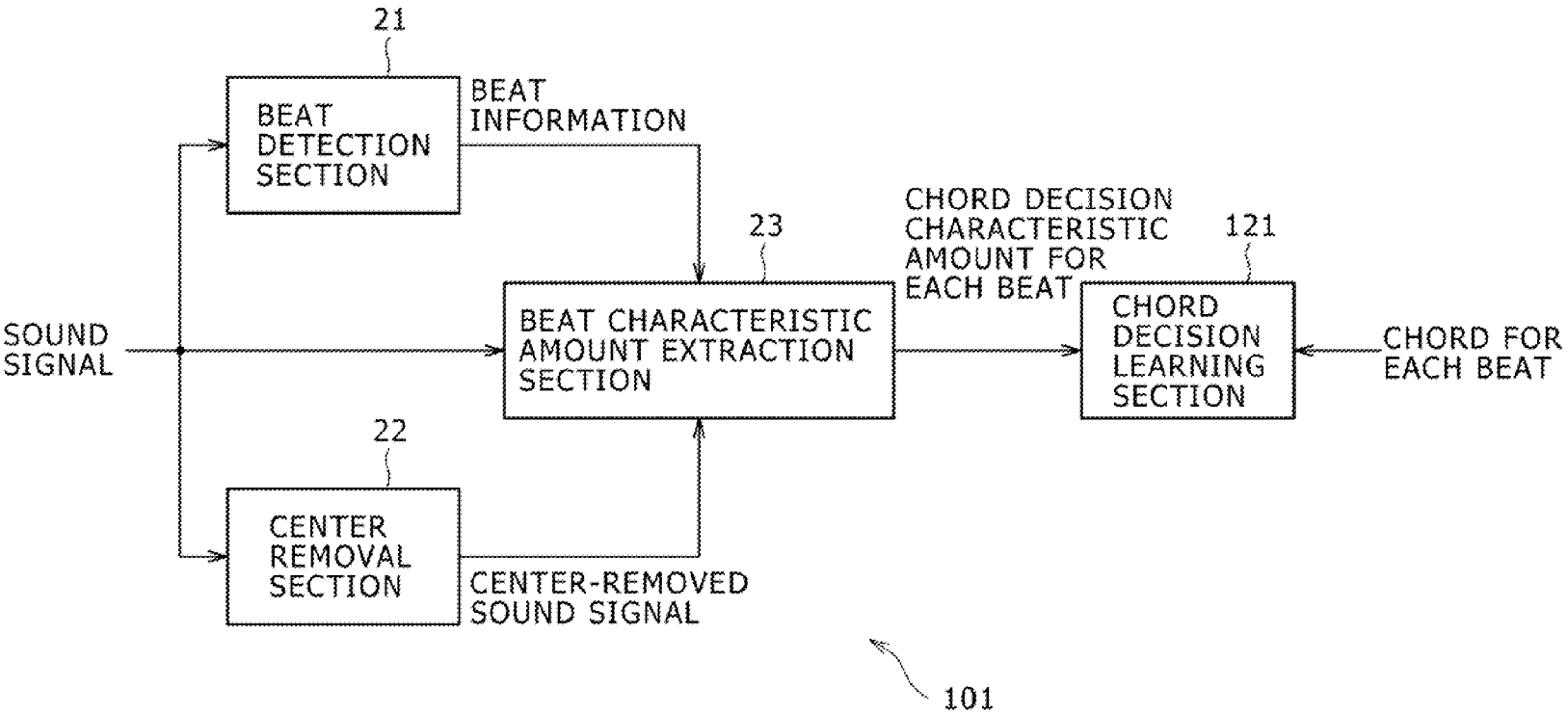
FIG. 29 is a block diagram showing an example of a configuration of a signal processing apparatus which performs learning based on a feature quantity for producing a chord decision section.

FIG. 29 shows an example of a configuration of the signal processing apparatus 101 which performs learning based on a feature quantity for producing the chord decision section 24.

Referring to FIG. 29, the signal processing apparatus 101 shown includes a beat detection section 21, a center removal section 22 and a beat feature quantity extraction section 23 similar to those described hereinabove with reference to FIG. 1. The signal processing apparatus 101 further includes a chord decision learning section 121.

The chord decision learning section 121 learns the decision of whether or not a reference sound from the chord decision feature quantity for each beat supplied from the beat feature quantity extraction section 23 is a root from the chord decision feature quantity for each beat and chords within a predetermined range of the sound signal.

For example, the chord decision learning section 121 learns decision of a chord within the range of a beat of the sound signal from the chord decision feature quantity for each beat supplied from the beat feature quantity extraction section 23 and a chord for each beat within the range of a beat indicated by the chord decision feature quantity for each beat. In particular, the chord decision learning section 121 learns decision of a chord within the range of a beat of the sound signal indicated by a feature quantity to another feature quantity from the feature quantity and a correct chord within the range of a beat of the sound signal indicated by the feature quantity.

Figure 30:
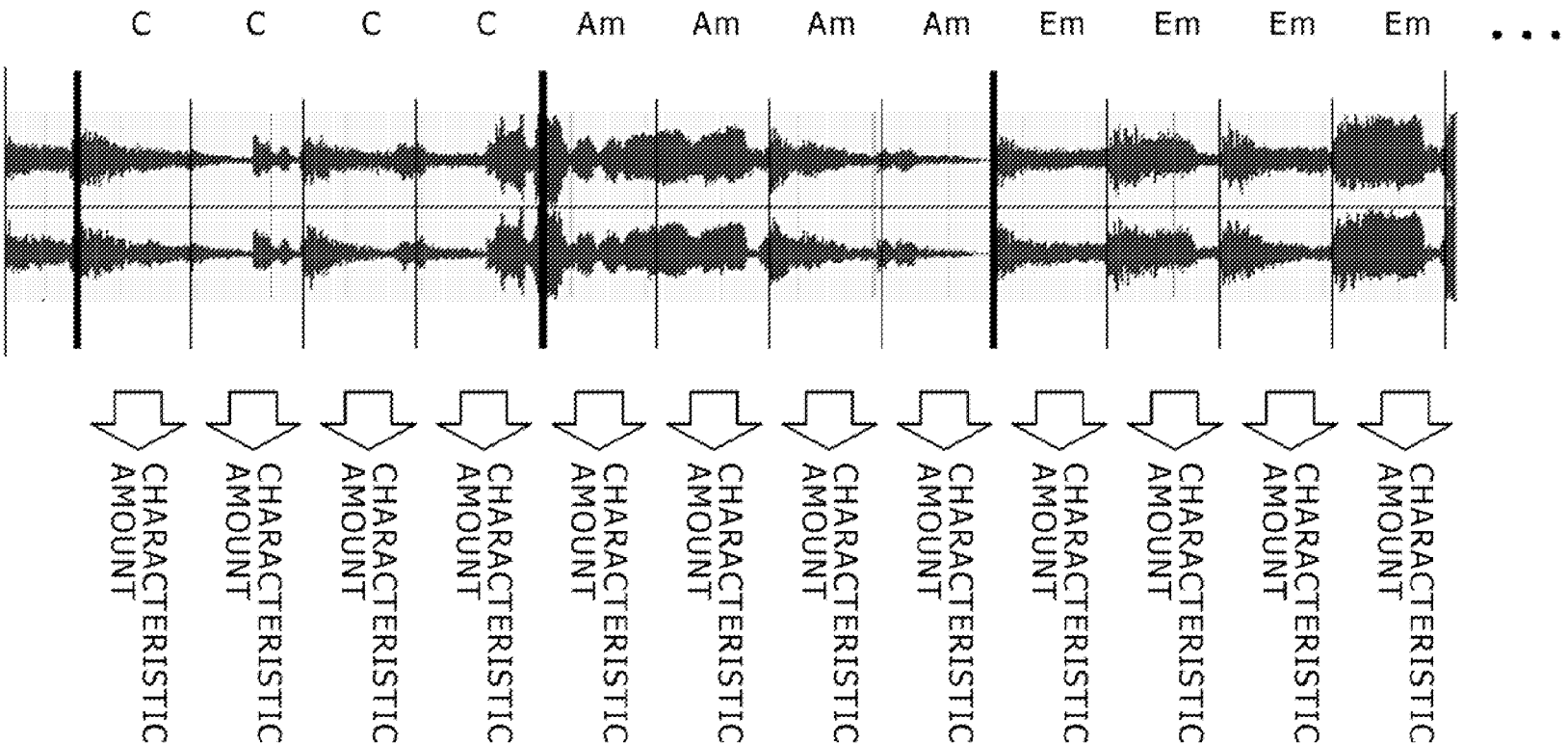
FIG. 30 is a view illustrating an example of chords within the range of beats indicated by a chord decision feature quantity for each beat.

A chord for each beat supplied to the chord decision learning section 121 indicates a correct chord within the range of a beat indicated by chord decision feature quantity for each beat as seen in FIG. 30. In particular, in this instance, the chord for each beat corresponding to the chord decision feature quantity for each beat within the range of 12 beats indicates correct chords of C, C, C, C, Am, Am, Am, Am, Em, Em, Em and Em within the range of the 12 beats.

Figure 31:
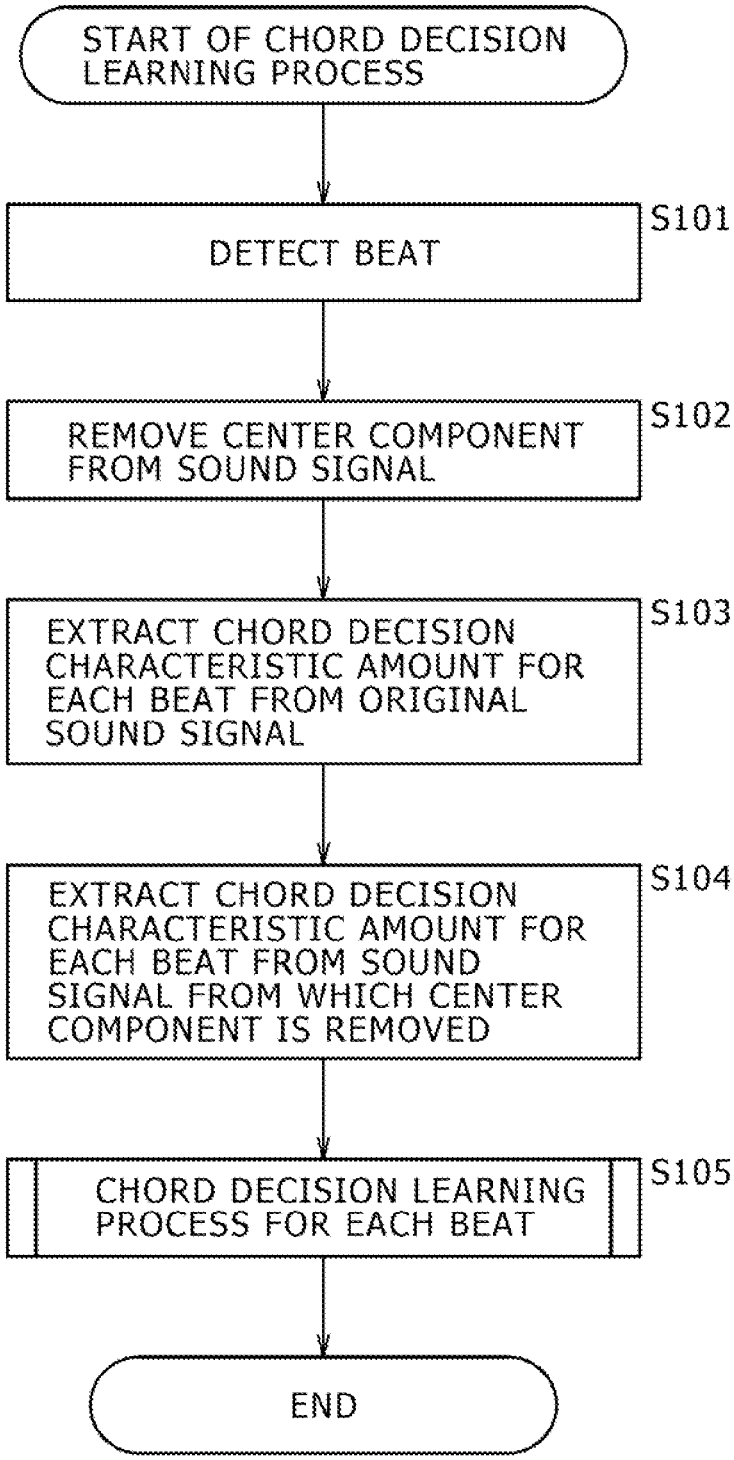
FIG. 31 is a flow chart illustrating a chord decision learning process.

Now, a chord decision learning process is described with reference to a flow chart of FIG. 31. Referring to FIG. 31, at steps S101 to S104, similar processes to those at steps S11 to S14 of FIG. 12 are executed, respectively.

At step S105, the chord decision learning section 121 executes a chord decision learning process for each beat. Then, the processing is ended.

The chord decision learning process for each beat at step S105 includes, for example, a process for learning a decision of whether or not a reference sound is a root and a process for learning decision of whether or not a chord is a major chord or a minor chord.

Figure 32:
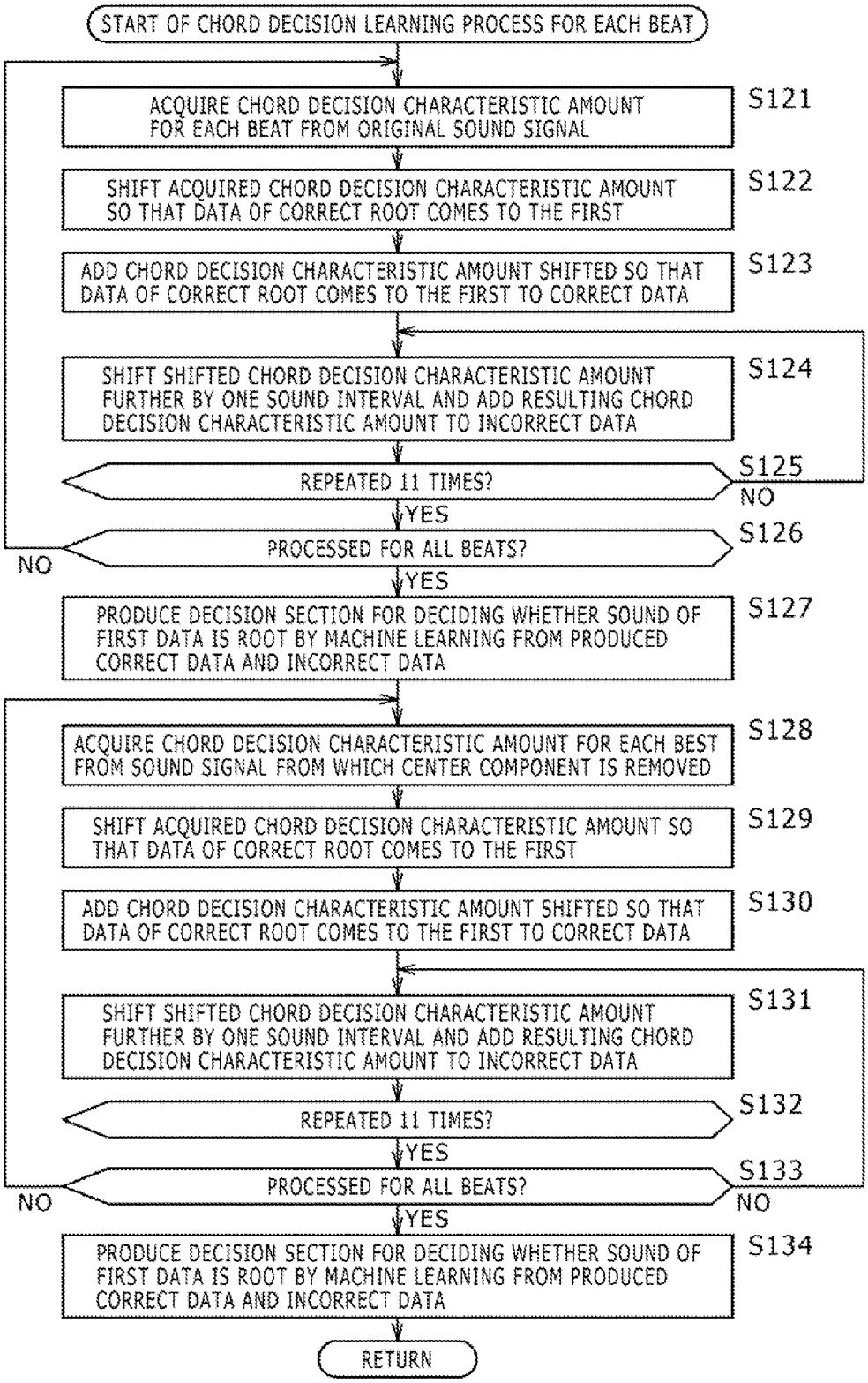
FIG. 32 is a flow chart illustrating a chord decision learning process for each beat for learning decision of whether a sound is a root.

FIG. 32 illustrates a chord decision learning process for each beat for learning decision of whether or not a reference sound is a root. Referring to FIG. 32, at step S121, the chord decision learning section 121 acquires the chord decision feature quantity for each beat from the original sound signal. In particular, in this instance, the chord decision learning section 121 acquires the original signal root decision feature quantity from among the chord decision feature quantity for each beat supplied from the beat feature quantity extraction section 23.

At step S122, the chord decision learning section 121 shifts the acquired chord decision feature quantity for each beat which are the original signal root decision feature quantity so that the data of the correct root comes to the top.

Figure 33:
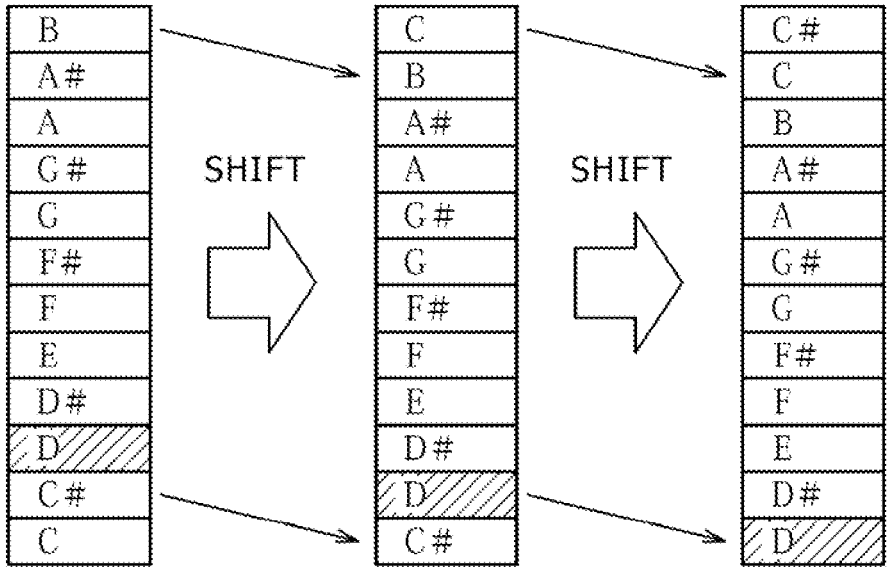
FIG. 33 is a view illustrating shifting of an original signal root decision feature quantity.

For example, as seen in FIG. 33, where data representative of the energy levels of the sounds of the sound names of C, C#, D, D#, E, F, F#, G, G#, A, A# and B are arranged in this order in the original signal root decision feature quantity of the chord decision feature quantity for each beat supplied from the beat feature quantity extraction section 23 and the correct chord indicated by the chord for each beat corresponding to the chord decision feature quantity for each beat is D, the chord decision learning section 121 shifts the original signal root decision feature quantity twice so that the data indicative of the energy level of the sound of the sound name of D is arranged at the top of the original signal root decision feature quantity.

In particular, the chord decision learning section 121 shifts the arrangement of the data indicative of the energy levels of the original signal root decision feature quantity so that data representative of the energy levels of the sounds of the sound names of C#, D, D#, E, F, F#, G, G#, A, A#, B and C may be arranged in this order. Further, the chord decision learning section 121 shifts the arrangement of the data indicative of the energy levels of the sounds of the original signal root decision feature quantity so that the data indicative of the energy levels of the sounds of the sound names of D, D#, E, F, F#, G, G#, A, A#, B, C and C# may be arranged in this order.

Referring back to FIG. 32, at step S123, the chord decision learning section 121 adds the chord decision feature quantity for each beat which are the original signal root decision feature quantity shifted so that the data of the correct root comes to the top to correct data.

At step S124, the chord decision learning section 121 shifts the shifted chord decision feature quantity for each beat further by one sound distance and adds the chord decision feature quantity for each beat which are the original signal root decision feature quantity to incorrect data.

At step S125, the chord decision learning section 121 decides whether or not the process at step S124 is repeated 11 times. Thus, the processing returns to step S124 until the process at step S124 is repeated 11 times.

If it is decided at step S125 that the process at step S124 is repeated 11 times, then the processing advances to step S126. At step S126, the chord decision learning section 121 decides that the processing is performed for all beats. If it is decided that the processing is not performed for all beats, then the processing returns to step S121 so that the processes described hereinabove are repeated for a next beat.

If it is decided at step S126 that the processing is performed for all beats, then the processing advances to step S127. At step S127, the chord decision learning section 121 produces a decision section for deciding whether or not the sound of the first data of the chord decision feature quantity for each beat is a root by machine learning from the correct data and the incorrect data produced depending upon the original signal root decision feature quantity.

Figure 34:
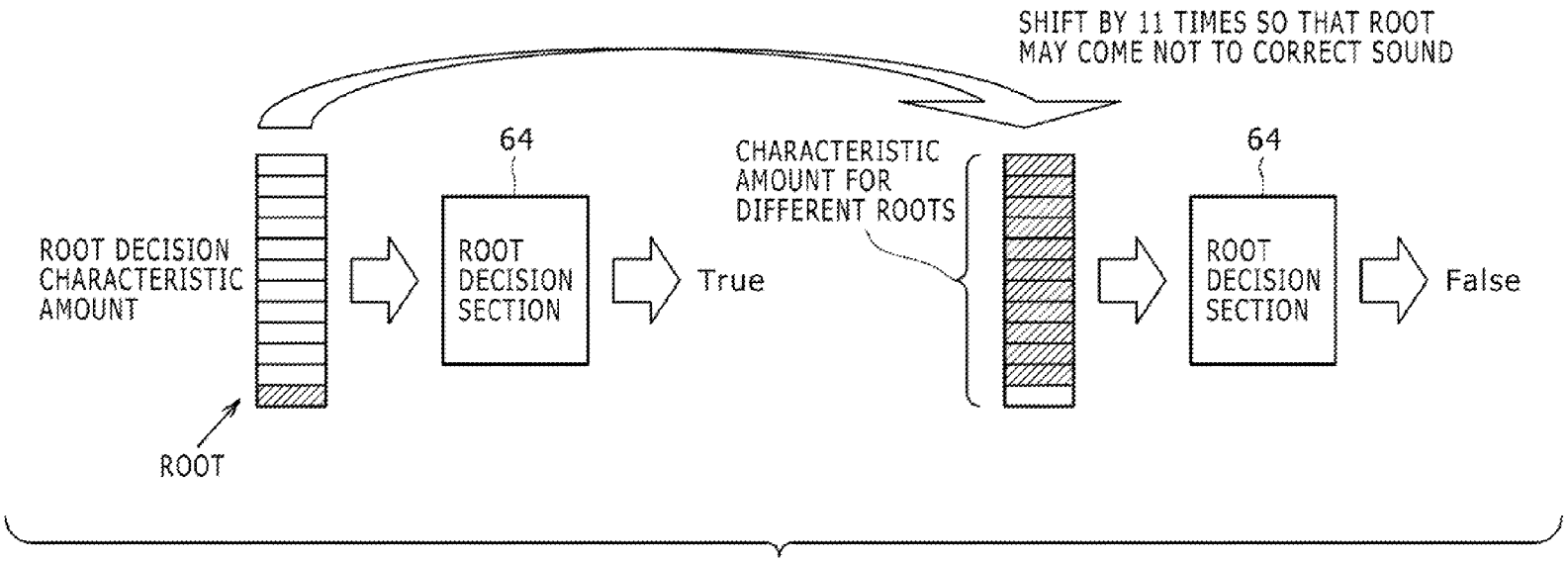
FIG. 34 is a view illustrating learning of decision of whether the sound of first data of the chord decision feature quantity for each beat is a root.

For example, as seen in FIG. 34, the chord decision learning section 121 performs learning of the root decision section 64 such that True is outputted in response to an input of the chord decision feature quantity for each beat wherein the sound of the first data is a root and which are correct data produced based on the original signal root decision feature quantity using GP (Genetic Programming), various repression analyses or the like and False is outputted in response to an input of the chord decision feature quantity for each beat wherein the sound of the first data is any other than a root and which are incorrect data produced based on the original signal root decision feature quantity.

At step S128, the chord decision learning section 121 acquires the chord decision feature quantity for each beat from the sound signal from which the center component is removed. In particular, in this instance, the chord decision learning section 121 acquires the center-removed root decision feature quantity from among the chord decision feature quantity for each beat supplied from the beat feature quantity extraction section 23.

At step S129, the chord decision learning section 121 shifts the acquired chord decision feature quantity for each beat which are center-removed root decision feature quantity so that the data of the correct root comes to the top.

For example, where the data representative of the energy levels of the sounds of the sound names of C, C#, D, D#, E, F, F#, G, G#, A, A# and B are arranged in order in the center-removed root decision feature quantity and the correct chord for each beat corresponding to the chord decision feature quantity for each beat is E, the chord decision learning section 121 shifts the center-removed root decision feature quantity four times so that the data indicative of the energy level of the sound of the sound name of E is arranged at the top of the center-removed root decision feature quantity.

At step S130, the chord decision learning section 121 adds the chord decision feature quantity for each beat which are the center-removed root decision feature quantity shifted so that the data of the correct root comes to the top to the correct data.

At step S131, the chord decision learning section 121 further shifts the shifted chord decision feature quantity for each beat by a one-sound distance and adds the chord decision feature quantity for each beat which are the center-removed root decision feature quantity.

At step S132, the chord decision learning section 121 decides whether or not the process at step S131 is repeated 11 times, and the processing returns to step S131 until after the process at step S131 is repeated by 11 times.

If it is decided at step S132 that the process at step S131 is repeated 11 times, then the processing advances to step S133, at which the chord decision learning section 121 decides whether or not the processing is performed for all beats. If it is decided that the processing is not performed for all beats, then the processing advances to step S128 so that the processes described above are repeated for all beats.

If it is decided at step S133 that the processing is performed for all beats, then the processing advances to step S134. At step S134, the chord decision learning section 121 produces a decision section for deciding whether or not the sound of the first data of the chord decision feature quantity for each beat is a root by machine learning from the correct data and the incorrect data produced based on the center-removed root decision feature quantity. Then, the processing is ended.

For example, the chord decision learning section 121 performs learning of the root decision section 64 such that True is outputted in response to an input of the chord decision feature quantity for each beat wherein the sound of the first data is a root and which are correct data produced based on the center-removed root decision feature quantity using GP (Genetic Programming), various recursive analyses or the like and False is outputted in response to an input of the chord decision feature quantity for each beat wherein the sound of the first data is any other than a root and which are incorrect data produced based on the center-removed root decision feature quantity.

Figure 35:
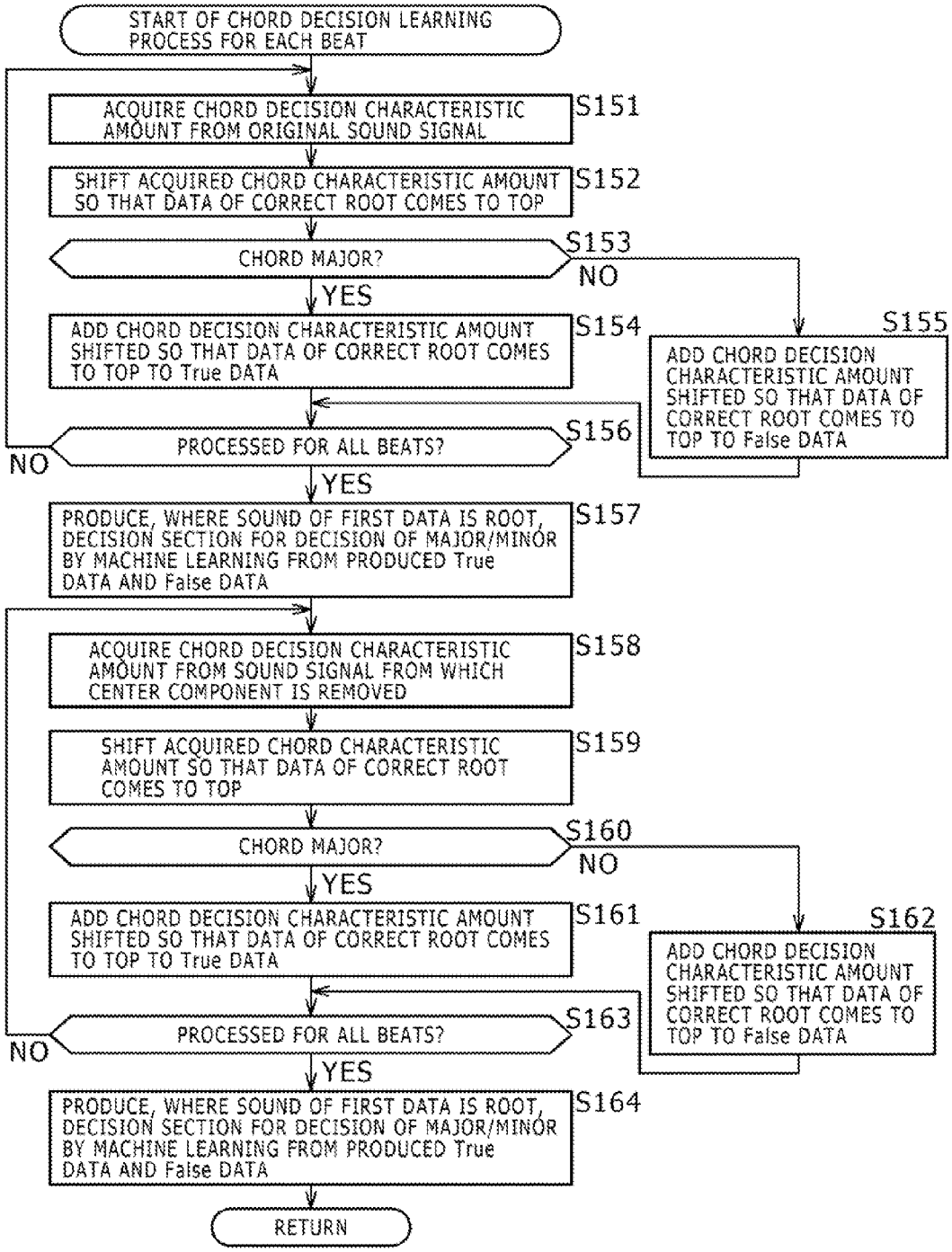
FIG. 35 is a flow chart illustrating a chord decision learning process for each beat for learning decision of whether a chord is a major chord or a minor chord.

Now, a chord decision learning process for each beat for learning the decision of a chord between a major chord and a minor chord is described with reference to FIG. 35. At step S151, the chord decision learning section 121 acquires the chord decision feature quantity for each beat from the original sound signal. In particular, in this instance, the chord decision learning section 121 acquires the original signal root decision feature quantity from among the chord decision feature quantity for each beat supplied from the beat feature quantity extraction section 23.

At step S152, the chord decision learning section 121 shifts the acquired chord decision feature quantity for each beat which are original signal major/minor decision feature quantity so that the data of the correct root comes to the top.

At step S153, the chord decision learning section 121 decides whether or not the correct chord of the beat corresponding to the chord decision feature quantity for each beat is a major chord. If it is decided that the correct chord is a major chord, then the processing advances to step S154. At step S154, the chord decision learning section 121 adds the chord decision feature quantity for each beat which are the original signal major/minor decision feature quantity shifted so that the data of the correct data comes to the top to the data of True. Then, the processing advances to step S156.

If it is decided at step S153 that the correct chord is not a major chord, that is, the correct chord is a minor chord, then the processing advances to step S155. At step S155, the chord decision learning section 121 adds the chord decision feature quantity for each beat which are the original signal major/minor decision feature quantity shifted so that the data of the correct data comes to the top to the data of False. Then, the processing advances to step S156.

At step S156, the chord decision learning section 121 decides whether or not the processing is performed for all beats. If it is decided that the processing is not performed for all beats, then the processing returns to step S151 so that the processes described above are repeated for a next beat.

If it is decided at step S156 that the processing is performed for all beats, then the processing advances to step S157. At step S157, the chord decision learning section 121 produces a decision section for the decision of whether a chord is a major chord or a minor chord by machine learning where, from the data of True and the data of False produced based on the original signal major/minor decision feature quantity, the sound of the first data of the chord decision feature quantity for each beat is a root.

Figure 36:
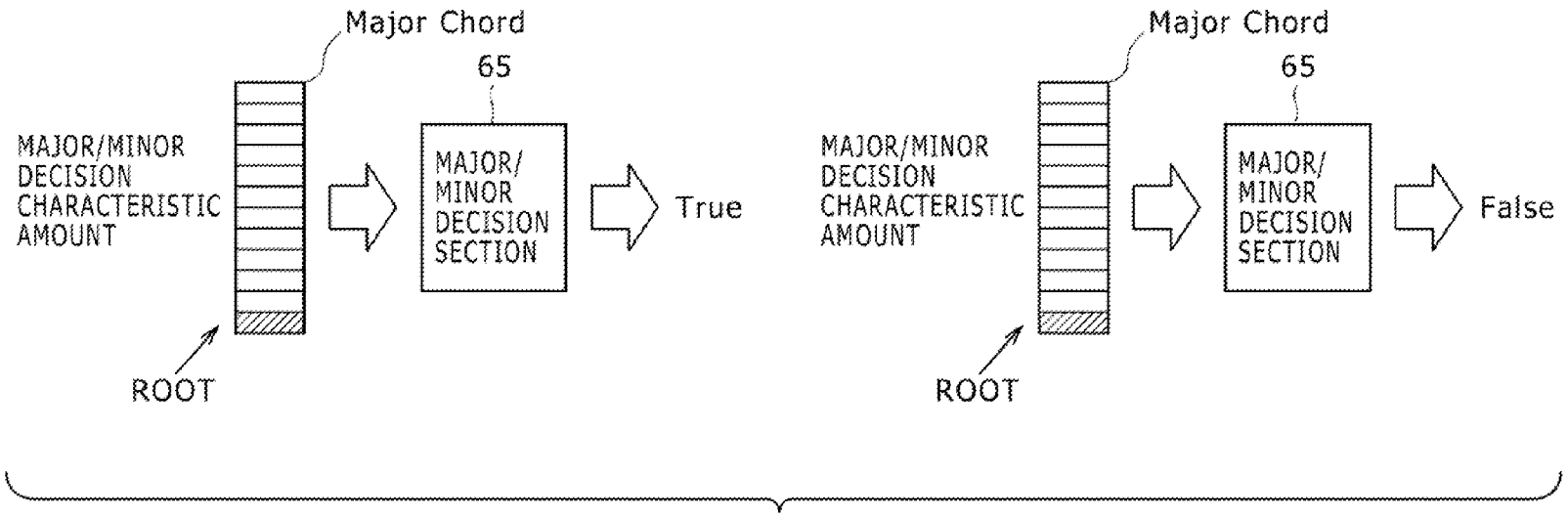
FIG. 36 is a view illustrating learning of decision of whether a chord is a major chord or a minor chord.

For example, as seen in FIG. 36, the chord decision learning section 121 performs learning of the major/minor decision section 65 such that True is outputted in response to an input of the data of True wherein the sound of the first data is a root and which are produced based on the original signal major/minor decision feature quantity extracted from the range of a beat of a major chord using GP, various recursive analyses or the like and False is outputted in response to an input of the data of False wherein the sound of the first data is a root and which are produced based on the original signal major/minor decision feature quantity extracted from the range of a beat of a minor chord.

Referring back to FIG. 35, at step S158, the chord decision learning section 121 acquires the chord decision feature quantity for each beat from the sound signal from which the center component is removed. In particular, in this instance, the chord decision learning section 121 acquires the center-removed major/minor decision feature quantity from among the chord decision feature quantity for each beat supplied from the beat feature quantity extraction section 23.

At step S159, the chord decision learning section 121 shifts the chord decision feature quantity for each beat which are center-removed major/minor decision feature quantity so that the data of the correct root comes to the top.

At step S160, the chord decision learning section 121 decides whether or not the correct chord of the beat corresponding to the chord decision feature quantity for each beat is a major chord. If it is decided that the correct chord is a major chord, then the processing advances to step S161. At step S161, the chord decision learning section 121 adds the chord decision feature quantity for each beat which are the center-removed major/minor decision feature quantity shifted so that the data of the correct root comes to the top to the data of True. Thereafter, the processing advances to step S163.

If it is decided at step S160 that the correct chord is not a major chord, that is, the correct chord is a minor chord, then the processing advances to step S162. At step S162, the chord decision learning section 121 adds the chord decision feature quantity for each beat which are the center-removed major/minor decision feature quantity shifted so that the data of the correct root comes to the top to the data of False. Thereafter, the processing advances to step S163.

At step S163, the chord decision learning section 121 decides whether or not the processing is performed for all beats. If it is decided that the processing is not performed for all beats, then the processing returns to step S158 so that the processes described above are repeated.

If it is decided at step S163 that the processing is performed for all beats, then the processing advances to step S164. At step S164, the chord decision learning section 121 produces a decision section for deciding, where the sound of the first data of the chord decision feature quantity for each beat is a root, whether the chord is a major chord or a minor chord by machine learning from the data of True and the data of False produced based on the center-removed major/minor decision feature quantity. Then, the processing is ended.

For example, the chord decision learning section 121 performs learning of the major/minor decision section 63 such that True is outputted in response to an input of the data of True wherein the sound of the first data is a root and which are produced based on the center-removed major/minor decision feature quantity extracted from the range of a beat of a major chord using GP, various recursive analyses or the like and False is outputted in response to an input of the data of False wherein the sound of the first data is a root and which are produced based on the center-removed major/minor decision feature quantity extracted from the range of a beat of a minor chord.

Now, learning for producing the correct chord decision section 91 is described.

Figure 37:
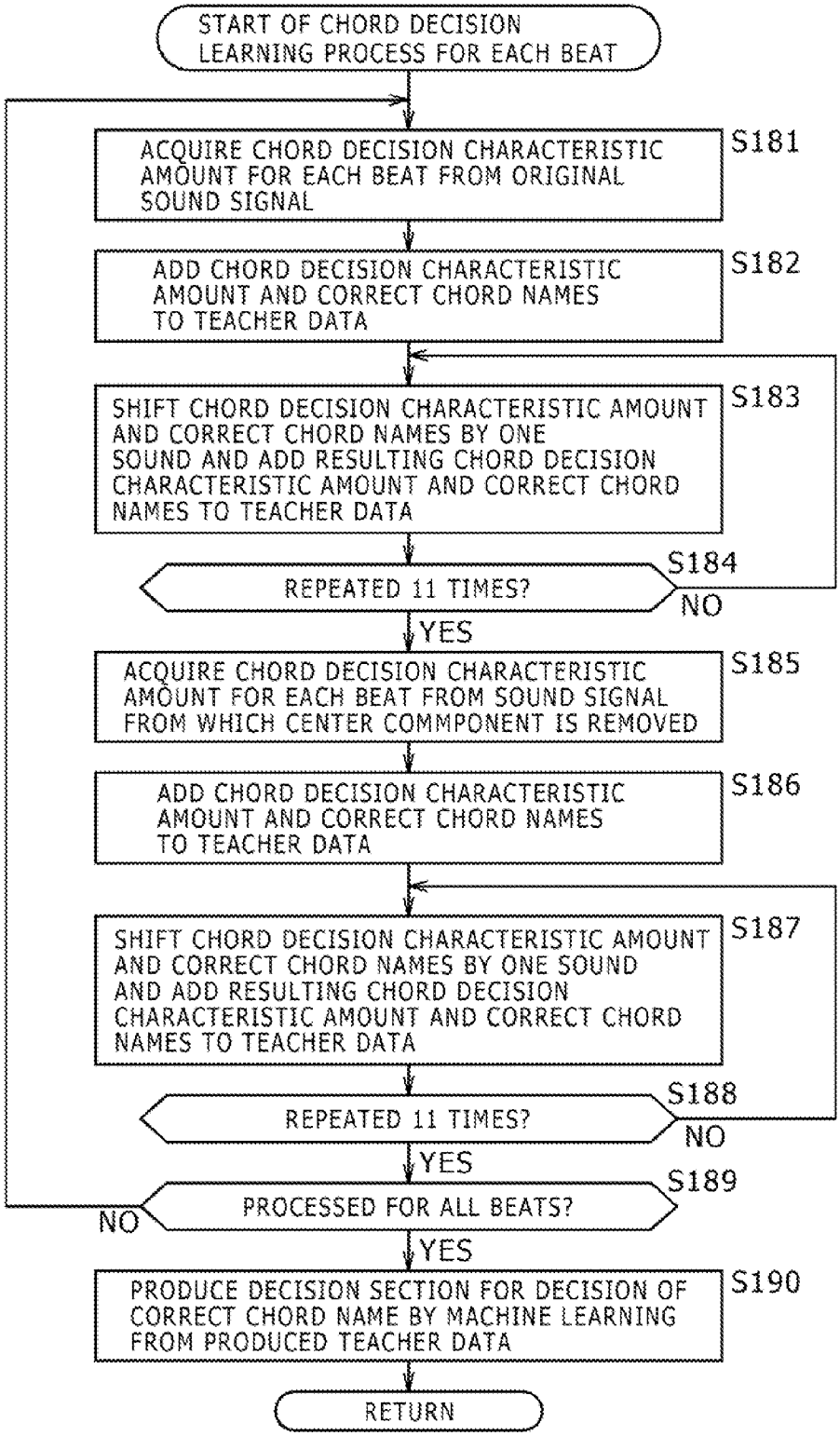
FIG. 37 is a flow chart illustrating a chord decision learning process for each beat for learning decision of whether a sound is a root and decision of whether a chord is a major chord or a minor chord.

FIG. 37 illustrates a chord decision learning process for each beat for learning decision of whether or not the sound of the first data is a root and a decision of whether the chord is a major chord or minor chord.

Referring to FIG. 37, first at step S181, the chord decision learning section 121 acquires the chord decision feature quantity for each beat from the original sound signal. In particular, in this instance, the chord decision learning section 121 acquires the original signal root decision feature quantity and the original signal major/minor decision feature quantity from among the chord decision feature quantity for each beat supplied from the beat feature quantity extraction section 23.

At step S182, the chord decision learning section 121 adds the chord decision feature quantity for each beat which are the original signal root decision feature quantity and the original signal major/minor decision feature quantity and the correct chord name which is a name of a correct chord indicated by a chord for each beat corresponding to the chord decision feature quantity for each beat to teacher data.

At step S183, the chord decision learning section 121 shifts the chord decision feature quantity for each beat which are the original signal root decision feature quantity and the original signal major/minor decision feature quantity and the correct chord name by a one-sound distance and adds the shifted chord decision feature quantity for each beat and correct chord name to the teacher data.

At step S184, the chord decision learning section 121 decides whether or not the process at step S183 is repeated 11 times, and the processing is returned to step S183 until after the process at step S183 is repeated 11 times.

If it is decided at step S184 that the process at step S183 is repeated 11 times, then the processing advances to step S185.

Figure 38:
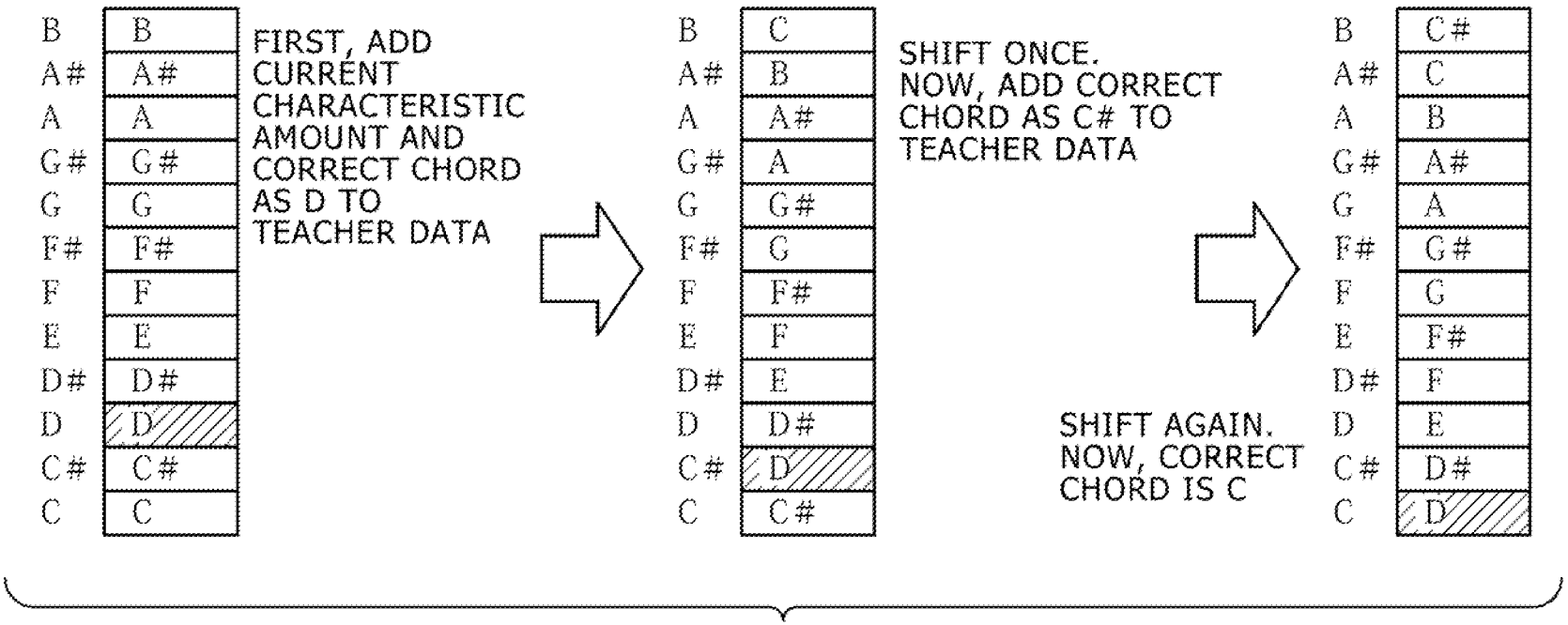
FIG. 38 is a view illustrating shifting of a chord decision feature quantity for each beat and a correct chord name.

For example, where the correct chord name which is the name of a correct chord indicated by a chord for each beat corresponding to the chord decision feature quantity for each beat is D as seen in FIG. 38, then the original signal root decision feature quantity and the original signal major/minor decision feature quantity wherein data representative of the energy levels of sounds of the sound names of C, C#, D, D#, E, F, F#, G, G#, A, A# and B are arranged in this order are added to the teacher data together with the correct chord name of D.

Then, the chord decision learning section 121 shifts the data representative of the energy levels of the sounds of the original signal root decision feature quantity and the original signal major/minor decision feature quantity so that the data indicative of the energy levels of the sounds of the sound names of C#, D, D#, E, F, F#, G, G#, A, A#, B and C may be arranged in this order. Further, the chord decision learning section 121 shifts the correct chord name to C#. The chord decision learning section 121 adds the original signal root decision feature quantity and the original signal major/minor decision feature quantity wherein the data indicative of the energy levels of the sounds of the sound names of C#, D, D#, E, F, F#, G, G#, A, A#, B and C are arranged in this order to the teacher data together with the correct chord name of C#.

Further, the chord decision learning section 121 shifts the data representative of the energy levels of the sounds of the original signal root decision feature quantity and the original signal major/minor decision feature quantity so that the data indicative of the energy levels of the sounds of the sound names of D, D#, E, F, F#, G, G#, A, A#, B, C and C# may be arranged in this order. Further, the chord decision learning section 121 shifts the correct chord name to D. The chord decision learning section 121 adds the original signal root decision feature quantity and the original signal major/minor decision feature quantity wherein the data indicative of the energy levels of the sounds of the sound names of D, D#, E, F, F#, G, G#, A, A#, B, C and C# are arranged in this order to the teacher data together with the correct chord name of D.

In this manner, shifting of the arrangement of the data indicative of the energy levels of the sounds in the original signal root decision feature quantity and the original signal major/minor decision feature quantity is repeated 11 times so that 12 data are added to the teacher data from one original signal root decision feature quantity and 12 data are added to the teacher data from one original signal major/minor decision feature quantity.

Referring back to FIG. 37, at step S185, the chord decision learning section 121 acquires the chord decision feature quantity for each beat from the sound signal from which the center component is removed. In particular, in this instance, the chord decision learning section 121 acquires the center-removed root decision feature quantity and the center-removed major/minor decision feature quantity from among the chord decision feature quantity for each beat supplied from the beat feature quantity extraction section 23.

At step S186, the chord decision learning section 121 adds the chord decision feature quantity for each beat which are the center-removed root decision feature quantity and the center-removed major/minor decision feature quantity and the correct chord name which is a name of a correct chord indicated by a chord for each beat corresponding to the chord decision feature quantity for each beat to the teacher data.

At step S187, the chord decision learning section 121 shifts the chord decision feature quantity for each beat which are the center-removed root decision feature quantity and the center-removed major/minor decision feature quantity and the correct chord name by a one-sound distance and adds the shifted chord decision feature quantity for each beat and correct chord name to the teacher data.

At step S188, the chord decision learning section 121 decides whether or not the process at step S187 is repeated 11 times, and the processing is returned to step S187 until after the process at step S187 is repeated 11 times.

If it is decided at step S188 that the process at step S187 is repeated 11 times, then the processing advances to step S189.

At step S189, the chord decision learning section 121 decides whether or not the processing is performed for all beats. If it is decided that the processing is not performed for all beats, then the processing returns to step S181 so that the processes described above are repeated for a next beat.

If it is decided at step S189 that the processes are performed for all beats, then the chord decision learning section 121 produces a decision section for deciding a correct chord name from the produced teacher data by machine learning. Thereafter, the processing is ended.

For example, at step S190, the chord decision learning section 121 produces a decision section for deciding a correct chord name from the produced teacher data using such a technique as k-Nearest Neighbor), SVM (Support Vector Machine), Naive Bayes, a Mahalanobis distance which determines a chord having the smallest distance as a correct chord or a GMM (Gaussian Mixture Model) which determines a chord having the highest probability as a correct chord.

In this manner, the chord decision learning section 121 performs learning of the correct chord decision section 91 for deciding a correct chord from the original signal root decision feature quantity and the original signal major/minor decision feature quantity as well as the center-removed root decision feature quantity and the center-removed major/minor decision feature quantity based on the teacher data produced as described above.

Where a sound signal is processed in such a manner as described above, a chord of music can be decided. Further, where feature quantity indicative of characteristics of sounds in the order of the musical scale with reference to a reference sound as a sound of a predetermined tone which are sounds of different tones of the 12-tone equal temperament within a predetermined range of a sound signal and whether or not the reference sound is a root is decided from the feature quantity by a means produced in advance by learning based on the feature quantity, a root of a chord of the piece of music can be decided accurately from the sound signal.

It is to be noted that the signal processing apparatus 11 may be any apparatus which processes a sound signal and can be configured, for example, as an apparatus which process a sound signal supplied from the outside or as a stationary apparatus or a portable apparatus which records and reproduces a sound signal.

Further, while an example wherein data representative of an energy level of a reference sound is arranged at the top of feature quantity is described in the foregoing description, the arrangement of such data is not limited to this, but data of an energy level of a reference sound may be disposed at an arbitrary position in the feature quantity such as the last or the middle of the feature quantity.

It is to be noted that, while the foregoing description is directed to decision of a chord within a range of a beat of a sound signal, the range for a chord is not limited to this, but a chord within a predetermined range of a sound signal such as a range of a bar or a range of a predetermined number of beats may be decided. In this instance, feature quantity of the sound signal within a range for decision of a chord are extracted.

While the series of processes described above can be executed by hardware, it may otherwise be executed by software. Where the series of processes is executed by software, a program which constructs the software is installed from a program recording medium into a computer incorporated in hardware for exclusive use or, for example, a personal computer for universal use which can execute various functions by installing various programs.

Figure 39:
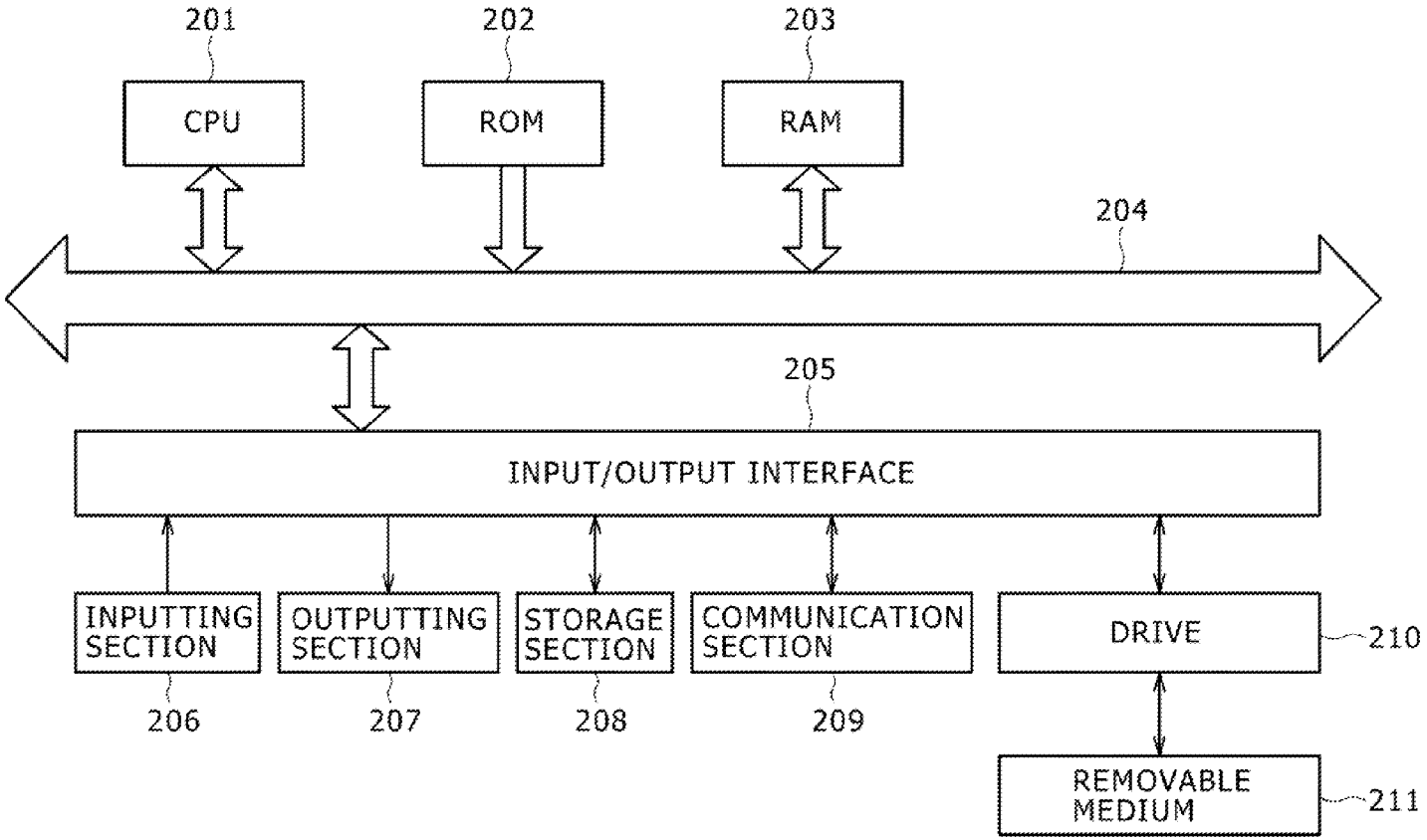
FIG. 39 is a block diagram showing an example of a configuration of a personal computer.

FIG. 39 shows an example of a configuration of a personal computer which executes the series of processes described hereinabove in accordance with a program. Referring to FIG. 39, a central processing unit (CPU) 201 executes various processes in accordance with a program stored in a read only memory (ROM) 202 or a storage section 280. A program to be executed by the CPU 201, data and so forth are suitably stored into a random access memory (RAM) 203. The CPU 201, ROM 202 and RAM 203 are connected to one another by a bus 204.

Also an input/output interface 205 is connected to the CPU 201 through the bus 204. An inputting section 206 including a keyboard, a mouse, a microphone and so forth and an outputting section 207 including a display unit, a speaker and so forth are connected to the input/output interface 205. The CPU 201 executes various processes in accordance with an instruction inputted from the inputting section 206. Then, the CPU 201 outputs a result of the processes to the outputting section 207.

A storage section 208 formed from a hard disk or the like is connected to the input/output interface 205 and stores a program to be executed by the CPU 201 and various data. A communication section 209 communicates with an external apparatus connected thereto through a network such as the Internet and/or a local area network.

A program may be acquired through the communication section 209 and stored into the storage section 208.

A drive 210 is connected to the input/output interface 205. When a removable medium 211 such as a magnetic disk, an optical disk, a magneto-optical disk, a semiconductor memory or the like is suitably loaded into the drive 210, the drive 210 drives the removable medium 211. Thereupon, the drive 210 acquires a program, data and so forth recorded on the removable medium 211. The acquired program or data are transferred to and stored into the storage section 208 as occasion demands.

The program recording medium on which a program to be installed into a computer and placed into an executable condition by the computer is recorded may be, for example, as shown in FIG. 39, a removable medium 211 in the form of a package medium formed from a magnetic disk (including a floppy disc), an optical disk (including a CD-ROM (Compact Disc-Read Only Memory) and a DVD (Digital Versatile Disc), a magneto-optical disk), or a semiconductor memory. Else, the program recording medium may be formed as the ROM 202, a hard disk included in the storage section 208 or the like in which the program is recorded temporarily or permanently. Storage of the program into the program recording medium is performed, as occasion demands, through the communication section 209 which is an interface such as a router and a modem, making use of a wired or wireless communication medium such as a local area network, the Internet or a digital satellite broadcast.

It is to be noted that, in the present specification, the steps which describe the program recorded in a program recording medium may be but need not necessarily be processed in a time series in the order as described, and include processes which are executed in parallel or individually without being processed in a time series.

While preferred embodiments of the present invention have been described using specific terms, such description is for illustrative purpose only, and it is to be understood that changes and variations may be made without departing from the spirit or scope of the following claims.

What is claimed is:

1. A signal processing apparatus, comprising:

removal means for removing, from a sound signal in the form of a stereo signal, a center component which is a component of sound positioned at the center between the left and the right;

extraction means for extracting, from the sound signal from which the center component is removed, first feature quantity representative of characteristics of sounds of different tones of the 12-tone equal temperament within a predetermined range; and decision means for deciding a chord within the predetermined range using the first feature quantity.

2. The signal processing apparatus according to claim 1, further comprising detection means for detecting the position of each of beats from the sound signal;

said extraction means extracting the first feature quantity within a range of each of the beats of the sound signal which is the predetermined range;

said decision means deciding a chord within the range of the beat using the first feature quantity.

3. The signal processing apparatus according to claim 1, wherein said removal means determines the difference between signals of one and the other of the channels of the sound signal which is in the form of a stereo signal to remove the center component from the sound signal.

4. The signal processing apparatus according to claim 1, wherein said removal means divides the sound signal in the form of a stereo signal into signals of a predetermined number of frequency bands and masks, if the difference between the phases of signals of one and the other of channels in any of the frequency bands is smaller than a threshold value determined in advance, the sound signal in the frequency band to remove the center component from the sound signal.

5. The signal processing apparatus according to claim 1, wherein said decision means includes:

root decision means for deciding, from the first feature quantity which represent energy levels of sounds of different tones in an order of the musical scale with reference to a reference sound which is a sound of a predetermined tone, whether or not the reference sound is a root; and chord type decision means for deciding at least whether the chord of the reference sound is a major chord or a minor chord from the first feature quantity.

6. The signal processing apparatus according to claim 5, wherein said decision means further includes a probability calculation means for calculating a probability that the reference sound is a root from a first discrimination function outputted from said route decision means and representative of a result of the decision regarding whether or not the reference sound is a root and calculating probabilities that the chord is a major chord and a minor chord from a second discrimination function outputted from said chord type decision means and representative of a result of decision regarding whether the chord is a major chord or a minor chord.

7. The signal processing apparatus according to claim 1, wherein said extraction means further extracts, from the sound signal from which the center component is not removed, second feature quantity representative of characteristics of sounds of different tones of the 2-tone equal temperament within the predetermined range, and said decision means uses the first and second feature quantity to decide the chord within the predetermined range.

8. The signal processing apparatus according to claim 7, wherein said decision means includes:

first root decision means for deciding, from the first feature quantity which represent energy levels of sounds of different tones in an order of the musical scale with reference to a first reference sound which is a sound of a predetermined tone, whether or not the first reference sound is a root;

second root decision means for deciding, from the second feature quantity which represent energy levels of sounds of different tones in an order of the musical scale with reference to a second reference sound which is a sound of another predetermined tone, whether or not the second reference sound is a root;

first chord type decision means for deciding at least whether the chord of the reference sound is a major chord or a minor chord from the first feature quantity; and second chord type decision means for deciding at least whether the chord of the reference sound is a major chord or a minor chord from the second feature quantity.

9. The signal processing apparatus according to claim 8, wherein said decision means further includes probability calculation means for:

calculating a probability that the first reference sound is a root from a first discrimination function outputted from said first route decision means and representative of a result of the decision regarding whether or not the first reference sound is a root;

calculating another probability that the second reference sound is a root from a second discrimination function outputted from said second route decision means and representative of a result of the decision regarding whether or not the second reference sound is a root;

calculating probabilities that the chord is a major chord and a minor chord from a third discrimination function outputted from said first chord type decision means and representative of a result of decision regarding whether the chord is a major chord or a minor chord; and calculating probabilities that the chord is a major chord and a minor chord from a fourth discrimination function outputted from said second chord type decision means and representative of a result of decision regarding whether the chord is a major chord or a minor chord.

10. A computer-implemented signal processing method, the computer including a processor and memory and the method comprising steps performed by the computer of:

removing, by the processor, from a sound signal in the form of a stereo signal, a center component which is a component of sound positioned at the center between the left and the right;

extracting, by the processor, from the sound signal from which the center component is removed, first feature quantity representative of characteristics of sounds of different tones of the 12-tone equal temperament within a predetermined range; and deciding, by the processor, a chord within the predetermined range using the first feature quantity.

11. A computer-readable recording medium storing a computer-executable program which, when executed by a processor, performs a signal processing method, the method comprising:

removing, from a sound signal in the form of a stereo signal, a center component which is a component of sound positioned at the center between the left and the right;

extracting, from the sound signal from which the center component is removed, first feature quantity representative of characteristics of sounds of different tones of the 12-tone equal temperament within a predetermined range; and deciding a chord within the predetermined range using the first feature quantity.

12. A signal processing apparatus, comprising:

a removal section configured to remove, from a sound signal in the form of a stereo signal, a center component which is a component of sound positioned at the center between the left and the right;

an extraction section configured to extract, from the sound signal from which the center component is removed, first feature quantity representative of characteristics of sounds of different tones of the 12-tone equal temperament within a predetermined range; and a decision section configured to decide a chord within the predetermined range using the first feature quantity.

* * * * *